US007195049B2

(12) United States Patent
Downs et al.

(10) Patent No.: US 7,195,049 B2
(45) **Date of Patent: *Mar. 27, 2007**

(54) HANDHELD MECHANICAL ADHESIVE SEGMENT APPLICATOR APPARATUS AND METHOD

(75) Inventors: John P. Downs, Colgate, WI (US); Dennis E. Lohr, Milwaukee, WI (US); Angela M. Obst, Milwaukee, WI (US); James J. Cigelske, Jr., Menasha, WI (US)

(73) Assignee: Glue Dots International, LLC, New Berlin, WI (US)

( * ) Notice: Subject to any disclaimer, the term of this patent is extended or adjusted under 35 U.S.C. 154(b) by 239 days.

This patent is subject to a terminal disclaimer.

(21) Appl. No.: 10/360,395

(22) Filed: Feb. 8, 2003

(65) Prior Publication Data

US 2003/0116284 A1 Jun. 26, 2003

Related U.S. Application Data

(63) Continuation-in-part of application No. 10/125,012, filed on Apr. 18, 2002, now Pat. No. 6,686,016, and a continuation-in-part of application No. 09/998,950, filed on Nov. 15, 2001, now Pat. No. 6,640,864, which is a continuation of application No. 09/363,200, filed on Jul. 29, 1999, now Pat. No. 6,319,442, which is a continuation-in-part of application No. 08/909,189, filed on Aug. 11, 1997, now Pat. No. 5,935,670.

(60) Provisional application No. 60/036,896, filed on Feb. 6, 1997.

(51) Int. Cl.
*B65C 11/00* (2006.01)
*B65C 9/18* (2006.01)

(52) U.S. Cl. ..... 156/577; 156/574; 156/579; 156/DIG. 48

(58) Field of Classification Search ..... 156/574, 156/577, 579, 540, 541, DIG. 33, DIG. 48
See application file for complete search history.

(56) References Cited

U.S. PATENT DOCUMENTS 2,276,297 A 3/1942 Flood (Continued)

FOREIGN PATENT DOCUMENTS

DE 4319023 C1 9/1994

(Continued)

OTHER PUBLICATIONS

Statement by Applicant in Compliance with 37 C.F.R. § 1.56, dated Oct. 11, 2005.

*Primary Examiner*—Mark A. Osele
(74) *Attorney, Agent, or Firm*—Reinhart Boerner Van Deuren s.c.

(57) ABSTRACT

A handheld adhesive segment applicator apparatus for use in combination with carrier release tape having pressure-sensitive adhesive segments attached thereto is disclosed which has a mechanism interacting an indexing instrumentality on the carrier release tape to facilitate the dispensing of individual adhesive segments. The indexing mechanism consists of a plurality of patterned scores, cuts, or indentations located in the surface of the carrier release tape, thereby allowing for an advancement mechanism in the handheld adhesive segment applicator apparatus to engage the carrier release tape. The indexed adhesive segment-laden carrier release tape may thereby be dispensed by the handheld mechanical adhesive segment applicator apparatus.

39 Claims, 14 Drawing Sheets

U.S. PATENT DOCUMENTS 2,373,092 A 4/1945 Avery
2,754,994 A 7/1956 Cole
2,838,171 A 6/1958 Kaspar
2,912,140 A 11/1959 Cole
3,066,881 A 12/1962 Krueger
3,225,916 A 12/1965 Field et al.
3,239,403 A 3/1966 Williams et al.
3,267,623 A 8/1966 Block
3,308,002 A 3/1967 Bremer et al.
3,464,883 A 9/1969 Moline et al.
3,567,148 A * 3/1971 Ottavan ..... 242/421.3
3,582,438 A 6/1971 Harbour
3,595,204 A 7/1971 McIntyre et al.
3,619,324 A 11/1971 Sato et al.
3,736,281 A 5/1973 Russell
3,741,786 A 6/1973 Torrey
3,881,041 A 4/1975 Glienke
3,969,181 A 7/1976 Seabold
3,997,702 A 12/1976 Schurb et al.
4,002,794 A 1/1977 Schwarcz
4,100,852 A 7/1978 Hamisch, Jr.
4,116,746 A 9/1978 Hamisch, Jr.
4,211,805 A 7/1980 Chamberlin
4,272,311 A * 6/1981 D'Angelo et al. ..... 156/215
4,294,357 A 10/1981 Stevens et al.
4,387,831 A 6/1983 McNally
4,440,830 A 4/1984 Wempe
4,452,667 A 6/1984 Chang
4,508,588 A * 4/1985 Parrish ..... 156/584
4,537,934 A 8/1985 Fock et al.
4,560,087 A * 12/1985 Sato et al. ..... 221/73
4,562,102 A 12/1985 Rabuse et al.
4,699,685 A 10/1987 Sato
4,718,971 A 1/1988 Summers
4,804,437 A 2/1989 Tirtoprodjo et al.
4,820,446 A 4/1989 Prud'Homme
4,822,687 A 4/1989 Kessel et al.
4,959,008 A 9/1990 Wasulko
4,961,804 A 10/1990 Aurichio
4,965,113 A 10/1990 Jones et al.
4,977,006 A 12/1990 Smith et al.
5,045,145 A * 9/1991 Becker ..... 156/384
5,049,434 A 9/1991 Wasulko
5,202,169 A 4/1993 Spendlove
5,254,206 A 10/1993 Wing
5,316,613 A 5/1994 Samuelson et al.
5,344,681 A 9/1994 Calhoun et al.
5,456,792 A 10/1995 Rodriguez et al.
5,489,453 A 2/1996 Friesch
5,683,545 A 11/1997 Goodwin et al.
5,685,944 A 11/1997 Nose et al.
5,779,852 A 7/1998 Haney et al.
5,875,715 A 3/1999 Hamisch, Jr. et al.
5,906,443 A 5/1999 Goodwin et al.
5,910,227 A 6/1999 Mistyurik et al.
5,934,189 A 8/1999 Mistyurik et al.
5,935,670 A 8/1999 Downs
5,988,249 A 11/1999 Mistyurik et al.
6,102,098 A 8/2000 Randazzo
6,171,439 B1 1/2001 Groeneweg
6,206,072 B1 3/2001 Orihara et al.
6,230,780 B1 5/2001 Rietheimer
6,280,565 B1 * 8/2001 Underwood ..... 156/577
6,319,442 B1 11/2001 Downs
6,363,990 B1 4/2002 Kozaki
6,433,055 B1 8/2002 Kleyer et al.
6,439,289 B1 8/2002 Schlotthauer
6,640,864 B2 11/2003 Downs
6,686,016 B2 2/2004 Downs
2002/0059984 A1 * 5/2002 Goodwin et al. ..... 156/577

FOREIGN PATENT DOCUMENTS

DE 20210691 U1 9/2002
EP 0609826 A 8/1994
EP 0619189 A2 10/1994
EP 0619189 A3 10/1994
EP 1233046 A 8/2002
EP 1445226 A3 9/2004
GB 2361442 10/2001
GB 2397258 A 7/2004
JP 2011684 1/1990
JP 2001 018586 A 1/2001

* cited by examiner

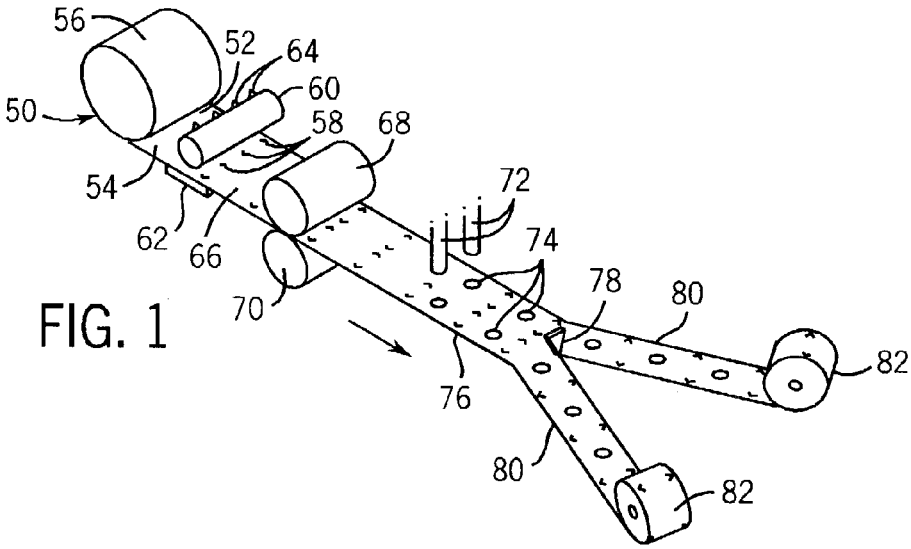
FIG. 1
FIG. 2
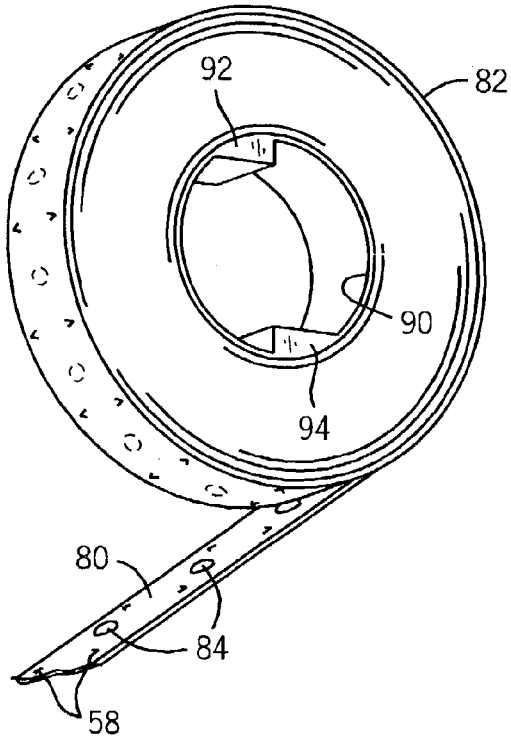
FIG. 3
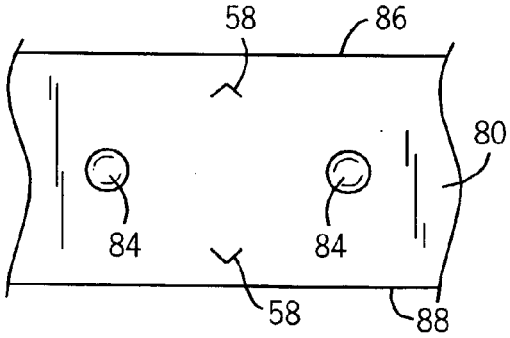

HANDHELD MECHANICAL ADHESIVE SEGMENT APPLICATOR APPARATUS AND METHOD

IDENTIFICATION OF RELATED PATENT APPLICATIONS

This patent application is a continuation in-part of U.S. patent application Ser. No. 10/125,012, filed on Apr. 18, 2002 now U.S. Pat. No. 6,686,016, entitled "Thermoplastic Adhesive Dispensing Method and Apparatus," and is also a continuation-in-part of U.S. patent application Ser. No. 09/998,950, filed on Nov. 15, 2001 now U.S. Pat. No. 6,640,864, entitled "Thermoplastic Adhesive Dispensing Method and Apparatus," both of which are continuations of U.S. patent application Ser. No. 09/363,200, filed on Jul. 29, 1999, now U.S. Pat. No. 6,319,442, entitled Process of Making a Thermoplastic Adhesive Dispensing Tape, which is in turn a continuation-in-part of U.S. patent application Ser. No. 08/909,189, filed on Aug. 11, 1997, now U.S. Pat. No. 5,935,670, entitled "Thermoplastic Adhesive Dispensing Method and Apparatus," which is in turn based upon U.S. Provisional Patent Application No. 60/036,896, filed on Feb. 6, 1997, all of which are assigned to the assignee of the present invention, and all of which are hereby incorporated herein by reference.

This application is related to concurrently filed, commonly assigned, copending U.S. patent application Ser. No. 10/360,457, entitled "Roll of Adhesive Segments for Use in an Adhesive Segment Applicator Apparatus and Method of Making the Same," which patent application is hereby incorporated herein by reference.

BACKGROUND OF THE INVENTION

Field of the Invention—The present invention relates generally to pressure-sensitive adhesives and their application to desired surfaces, and more specifically to a mechanical handheld adhesive segment applicator apparatus for use in combination with rolls of indexed carrier release tape having pressure-sensitive adhesive segments attached thereto which may be individually dispensed using the mechanical handheld adhesive segment applicator apparatus.

Adhesives are more than just substances serving to hold materials together by surface attachment. The term "adhesive" is simplistic and explains little, but generically describes a class of "sticky" materials. Adhesives and adhesive applicators owe their innovation to the Industrial Revolution, which resulted in an explosion of technical and scientific breakthroughs. The breakthroughs of the Industrial Revolution included the introduction of new materials and ingredients for use in formulating market-specific and industry-specific adhesives. In creating novel adhesives, companies have diligently considered desirable qualities such as adhesive flexibility, toughness, minimum curing or setting time, and temperature and chemical resistance. Today, the technology and underlying science of adhesives and apparatuses for their application is the foundation for a multi-billion dollar industry with over 700 companies competing for market share. More importantly, these companies strive to create and introduce novel adhesives as well as apparatuses and methods for the simple, efficient, inexpensive, and safe application of adhesives.

One of the most significant adhesive technical breakthroughs of the past century has been the introduction of pressure-sensitive thermoplastic adhesives. Thermoplastic adhesives have excellent adhering qualities; they can be softened by heating and firmed by cooling. These characteristics help thermoplastic adhesives produce waterproof, resilient, and long-lasting flexible bonds. Thermoplastic adhesives have what is known as a "plastic memory," meaning that each time a thermoplastic adhesive is heated, it can be molded into any desired form.

Thermoplastic adhesives have significant applications in today's industry. For example, in the preparation of mass mailings, marketers often desire to attach a card, such as a credit card or the like, to a carrier document so that a consumer can peel the card easily from the carrier document. One method of making such an attachment involves the use of a pressure-sensitive, thermoplastic adhesive. For example, by using a heating container to melt thermoplastic adhesive and a metering pump to dispense it during the printing or collating process, a portion of thermoplastic adhesive can be metered onto the carrier document and the credit card pressed against it.

In addition to the uses for thermoplastic adhesives described above, industry is now finding additional uses for them. For example, thermoplastic adhesives are routinely used and applied as small bond points to eliminate the use of mechanical fasteners, such as staples, screws, rivets, clips, snaps, nails, and stitching. Thermoplastic adhesives are also extensively used in the packaging and manufacture of cartons, boxes and corrugated boards, bags, envelopes, disposable products (diapers and other paper products), cigarettes, labels, and stamps. In fact, today's demand for thermoplastic adhesives extends to very broad fields of use and is not limited to assembly line-like settings.

Increasingly, industry demands thermoplastic adhesive application at on-site locations from portable, simple-to-use, efficient, inexpensive, and safe dispensing apparatuses. Additionally, such dispensing apparatuses must be able to adhere thermoplastic adhesives to non-planar, recessed, difficult to reach, or unstable surfaces. Previously known apparatuses and methods have failed to provide an adequate portable, simple-to-use, efficient, inexpensive, and safe dispensing device and a thermoplastic adhesive carrying medium capable of applying thermoplastic adhesives to non-planar, recessed, difficult to reach, or unstable surfaces.

In providing thermoplastic adhesives for application to a surface, the previously known embodiments have contemplated all of the following thermoplastic adhesive carrying media and application methods: hot-melt "glue-gun" adhesive dispensers; adhesive segment-laden carrier release tape for "by hand" adhesive application; use of a plunger-like dispensing system in combination with adhesive segment-laden carrier release tape, which proves to be cumbersome and which has a limited utility of application to planar surfaces; use of a cardboard box applicator system for use in combination with adhesive segment-laden carrier release tape, which is also limited in application to planar, non-recessed surfaces; and an electric automated dispensing system for use with adhesive segment-laden carrier release tape, which is activated by the pressing of a palm-sized push button, and which also only allows for application of thermoplastic adhesives to unobstructed planar surfaces.

Using a "glue gun" device is an inefficient, difficult, and at times unsafe method of applying thermoplastic adhesives to a desired surface. First, the cost of using this equipment is relatively high. The apparatus and method are also inefficient consumers of both energy and glue. Specifically, the costs of the activation of such a dispenser (electrical usage, wasted glue from droppings) for only short periods of time outweigh any other potential advantages which may be realized.

Safety is also an issue. Glue-gun devices are potentially unsafe because they include a heat source to heat a quantifiable supply of adhesive material to its melting point. A major drawback of using such an instrument is that the hot, molten thermoplastic adhesive can burn untrained users, and can also melt the substrate the user is applying the glue to. Finally, application of thermoplastic adhesives from a glue-gun does not enable the thermoplastic adhesive to withstand cold temperatures or to cool to a smooth surface, but instead will typically leave "spider webs" in the dried adhesive. In short, glue-gun applicators of the prior art are inefficient, difficult, and unsafe.

Many of the shortcomings of the glue-gun instruments of the prior art were solved by U.S. Pat. No. 5,935,670 to Downs (the "'670 Patent"), which patent is hereby incorporated herein by reference. However, upon further use of the technology of the '670 Patent, several shortcomings have become apparent. Specifically, while the '670 Patent discloses a method for presenting cooled adhesive segments for application to a desired surface, the application of the segments to the surface proves to be very inefficient.

The technology of the '670 Patent focuses mainly on the manufacture of a clean, unaltered carrier release tape having first and second release surfaces with different coefficients of friction, and the application thereto of adhesive segments at periodic intervals. The adhesive segment-laden carrier release tape is then wound into a roll. This embodiment allows a user to apply the adhesive segments from the carrier release tape by hand. Although such an embodiment provides a highly innovative and commercially successful product, application of the adhesive segments remains inefficient and cumbersome.

Specifically, the coiled adhesive segment-laden carrier release tape must be unrolled to present a adhesive segment for application. After the adhesive segment has been applied to the desired surface, the tape must be unrolled an additional distance to ready the next adhesive segment for application. Such a method is time-consuming, and the "spent" carrier release tape must be either torn off and disposed of or left intact and in the way. Finally, dropping or uncoiling the unused roll of adhesive segment-laden carrier release tape has also been a problem.

U.S. Pat. No. 6,319,442 to Downs (the "'442 Patent"), which patent is hereby incorporated herein by reference, further evolved the previously known adhesive segment-laden carrier release tape of the '670 Patent. Like the '670 Patent, the '442 Patent also contemplates a carrier release tape, which has first and second release surfaces with different coefficients of friction, and the application thereto of adhesive segments at periodic intervals. But unlike the '670 Patent, the '442 Patent contemplates a thermoplastic adhesive carrier release tape having a transverse line of slits or perforations precut across its transverse width and between the adhesive segments.

The precut tape of the '670 Patent thus allows individual portions of the carrier release tape and associated thermoplastic adhesive to be removed from the roll for manual application to a desired surface. While such an embodiment remedies the '670 Patent's problem of having a length of uncut spent carrier release tape, the carrier release tape of the '442 Patent (as well as of the '670 Patent) does not lend itself to use in combination with a more efficient dispenser for application of the adhesive segments to non-planar, recessed, difficult to reach, or unstable surfaces.

While the '670 and '442 Patents focus primarily on the creation of adhesive segment-laden carrier release tape, they also contemplate use of the adhesive segment-laden carrier release tape in combination with numerous dispenser apparatuses. First, a plunger-like applicator, as detailed within both the '670 and '442 Patents, proves manageable, but is limited in the type of surfaces that the thermoplastic adhesive may be applied to. Specifically, because the plunger mechanism has an attached planar foot portion, which is used to guide the placement of the adhesive segments, application of the thermoplastic adhesive segments is essentially confined to an unobstructed flat surface. Such a limitation can pose significant problems when attempting to apply thermoplastic adhesives to non-flat surfaces. It may be more practical to use the above "by hand" manual method of thermoplastic adhesive application.

Another previously known thermoplastic adhesive applicator that presents some apparent problems is the so-called box applicator. This applicator is also limited in thermoplastic adhesive application to planar surfaces. The box applicator encases a roll of adhesive segment-laden carrier release tape as disclosed within the '670 and '442 Patents. When the carrier release tape is advanced from the box applicator by hand, the thermoplastic adhesive can only be applied to surfaces that are of a generally planar nature.

The adhesive segments must be pressed between the surface to be glued and the top of the cardboard box applicator to ensure adherence. This application process exposes unspent adhesive segments to dust and other debris, which may cause the adhesive segments to lose their adhesive tack and damage or soil the desired surface. Additionally, because the cardboard box thermoplastic adhesive applicator must be of a certain size to house a spool of carrier release tape, application of adhesive segments to areas that are non-flat or recessed proves to be difficult, if not impossible.

While not all previously known thermoplastic adhesive applicators are manual, even applicators that are automated present problems. For example, while automated thermoplastic adhesive applicators are more efficient than the box applicator described above, they are also more expensive. The previously known automated methods dispose of the need to manually advance the carrier release tape, but are one-of-a-kind units and thus represent a very expensive option for both the adhesive manufacturer and the end user. Automated thermoplastic adhesive applicators are also limited to thermoplastic adhesive application to generally planar surfaces. In short, their limitations are similar to those of the previously known embodiments presented above because, due to their size, they may not be positioned for the application of thermoplastic adhesive into recessed areas or onto generally non-flat surfaces.

Thus, it will be appreciated that previously known apparatuses and methods have only contemplated use of the thermoplastic adhesive laden carrier release tape taught in the '670 Patent and the '442 Patent. The drawbacks of the previously known adhesive segments and methods of applying the same have been used in the industry without any marked improvement to date. In short, the application of adhesive segments from the carrier release tape remains inefficient, overly expensive, and generally inadequate for the application of adhesive segments to non-flat, recessed, difficult to reach, or unstable surfaces.

It is accordingly the primary objective of the present invention that it provide a handheld mechanical adhesive segment applicator apparatus capable of dispensing adhesive segments from an adhesive segment-laden carrier release tape. It is a related objective of the present invention that the handheld mechanical adhesive segment applicator apparatus have a drive mechanism for engaging an indexing instrumentality on the adhesive segment-laden carrier release tape to allow it to dispense adhesive segments.

It is another objective of the present invention that the handheld mechanical adhesive segment applicator apparatus be adaptable to apply adhesive segments to non-flat, recessed, difficult to reach, or unstable surfaces. It is a further objective of the present invention that it provide for the application of adhesive segments in a simple, efficient, safe, and automatic manner.

The handheld mechanical adhesive segment applicator apparatus of the present invention must also be of construction which is both durable and long lasting, and it should also require little or no maintenance to be provided by the user throughout its operating lifetime. In order to enhance the market appeal of the handheld mechanical adhesive segment applicator apparatus of the present invention, it should also be of inexpensive construction to thereby afford it the broadest possible market. Finally, it is also an objective that all of the aforesaid advantages and objectives of the handheld mechanical adhesive segment applicator apparatus of the present invention be achieved without incurring any substantial relative disadvantage.

SUMMARY OF THE INVENTION

The disadvantages and limitations of the background art discussed above are overcome by the present invention. While the present invention takes full advantage of previously known basic technology, it also addresses all known shortcomings of the basic technology. The present invention provides a handheld mechanical adhesive segment applicator apparatus which utilizes a unique, indexed adhesive segment-laden carrier release tape.

The indexing instrumentality consists of a plurality of patterned scores, cuts, or indentations located in the surface of the carrier release tape, thereby allowing for an advancement mechanism to protrude therethrough. Adhesive segments may be pre-metered onto the carrier release tape before indexing occurs, or the indexing may occur first and the adhesive may be applied thereafter. The handheld mechanical adhesive segment applicator apparatus of the present invention provides a manner of using the indexed adhesive segment-laden carrier release tape to apply adhesive segments to non-flat, recessed, difficult to reach, or unstable surfaces.

The carrier release tape is flexible, extends longitudinally, and in the preferred embodiment can have a transverse width of approximately one inch. Additionally, it has opposed first and second release surfaces, each having a different coefficient of friction than the other. Adhesive segments are arrayed generally longitudinally along the first release surface of the carrier release tape (although they instead may be staggered if desired). While the adhesive segments are preferably circular, they may instead be of other different shapes and configurations including, but not limited to, squares, triangles, ovals, dots, other geometric figures, caricature shapes, and the like.

The carrier release tape may be made from plain stock carrier release tape, which can be cut into individual tape strips either before or after the indexing and the adhesive segment application processes. The transverse width of the preferred embodiment is approximately one inch although the dimensions of the carrier release tape strips may vary in accordance with the handheld mechanical adhesive segment applicator apparatus of the present invention with which it is used, and the advancement mechanism associated therewith.

The carrier release tape has first and second sides with different coefficients of friction. The second surface has a coefficient of friction different from that of the first so that adhesive segments do not adhere to it as strongly as they do to the first surface. The handheld mechanical adhesive segment applicator apparatus of the present invention and the carrier release tape also present a number of key advantages through their use of indexing therein.

First, the indexing is used by the present invention in the carrier release tape to allow for accurate and specific placement of adhesive segments on the carrier release tape. In the preferred embodiment, the indexing is uniformly located in the carrier release tape with regard to the position of adhesive segments at specific distances between each index. Second, the indexing plays an integral role in the application of the adhesive segments from the carrier release tape. The indices are engageable by the advancement mechanism of the handheld mechanical adhesive segment applicator apparatus of the present invention, thereby facilitating advancement of the carrier release tape to present the adhesive segments to a desired surface.

The formation of the indices in the carrier release tape may occur either before or during the actual production of the individual strips of adhesive segment-laden carrier release tape. Regardless of when the carrier release tape is indexed, the indexing may be accomplished by using and one of various methods. For example, the indices may be created by the striking of a steel rule die against the carrier release tape, or, alternatively, by use of a rotary die which turns against the carrier release tape in relation to its linearly displaced cutting surface. While the above methods of cutting are already generally known, their relation to the adhesive segment-laden carrier release tape and adaptation for use in the handheld mechanical adhesive segment applicator apparatus of the present invention are novel.

The indexed patterns and embodiments of the carrier release tape may vary. One embodiment includes the creation of notches in the carrier release tape. Specifically, it is contemplated that each indexed notch consists of two angled cuts forming a wide "V" shape in the carrier release tape surface. Such angled, V-shaped cuts may be positioned near opposite sides of the carrier release tape with the points of each V facing away from each other. Thus, the open portions of each pair of indexed notches face one another across the transverse width of the carrier release tape Indexed patterns other than the notching embodiments discussed above may also be used. For example, the indexed patterns may vary in accordance with the shape and positioning of the advancement mechanism used by the handheld mechanical adhesive segment applicator apparatus of the present invention.

Thus, the indexed patterns of the adhesive segment-laden carrier release tape allows for its use with the handheld mechanical adhesive segment applicator apparatus of the present invention. The handheld mechanical adhesive segment applicator apparatus is used in conjunction with the adhesive segment-laden carrier release tape, which has an advancement mechanism which engages the indexed pattern of the indexed carrier release tape to advance the tape along a desired path. The handheld mechanical adhesive segment applicator apparatus thus uses the indexed patterns of the carrier release tape to facilitate the simple, efficient, inexpensive, and safe application of adhesive segments to non-planar, recessed, difficult to reach, or unstable surfaces.

A roll of the indexed adhesive segment-laden carrier release tape is inserted into the handheld mechanical adhesive segment applicator apparatus, which has a spool-type tape holder. The holder, and the design of the apparatus in general, ensures that the adhesive segments are protected from dust and debris until ready for application to a desired surface. The advancement mechanism of handheld mechanical adhesive segment applicator apparatus interacts with the indexed notches of the carrier release tape, thereby advancing the adhesive segments on the carrier release tape to an application point from which the adhesive segments may be applied to a desired surface.

It may therefore be seen that the present invention teaches a handheld mechanical adhesive segment applicator apparatus capable of dispensing adhesive segments from an adhesive segment-laden carrier release tape. The handheld mechanical adhesive segment applicator apparatus has a drive mechanism for engaging an indexing instrumentality on the adhesive segment-laden carrier release tape to allow it to dispense adhesive segments. The handheld mechanical adhesive segment applicator apparatus is adaptable to apply adhesive segments to non-flat, recessed, difficult to reach, or unstable surfaces in a simple, efficient, safe, and automatic manner.

The handheld mechanical adhesive segment applicator apparatus of the present invention is of construction which is both durable and long lasting, and which requires little or no maintenance to be provided by the user throughout its operating lifetime. The handheld mechanical adhesive segment applicator apparatus of the present invention is also of inexpensive construction to enhance its market appeal and to thereby afford it the broadest possible market. Finally, all of the aforesaid advantages and objectives of the handheld mechanical adhesive segment applicator apparatus of the present invention are achieved without incurring any substantial relative disadvantage.

DESCRIPTION OF THE DRAWINGS

These and other advantages of the present invention are best understood with reference to the drawings, in which:

FIG. 1 is a schematic depiction of the manufacturing process for creating rolls of indexed adhesive segment-laden carrier release tape;

FIG. 2 is an isometric view of a roll of indexed adhesive segment-laden carrier release tape manufactured by the process illustrated in FIG. 1;

FIG. 3 is a top plan view of a segment of the indexed adhesive segment-laden carrier release tape from the roll illustrated in FIG. 2;

DETAILED DESCRIPTION OF THE PREFERRED EMBODIMENT

Figure 4:
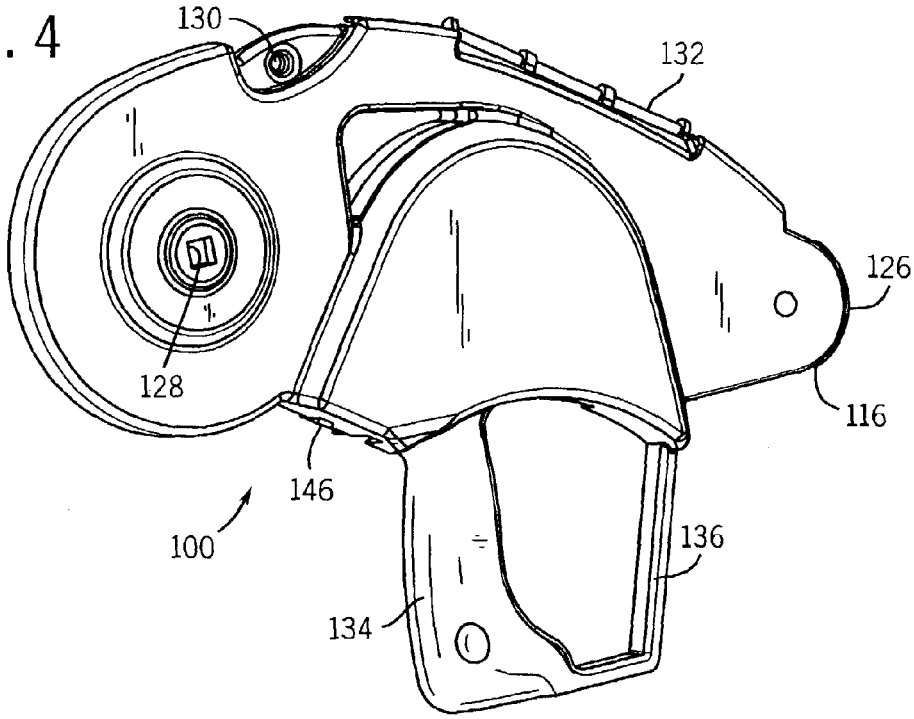
FIG. 4 is a plan view of the outside of a right housing member for a handheld mechanical adhesive segment applicator apparatus constructed according to the teachings of the present invention.

The preferred embodiment of the handheld mechanical adhesive segment applicator apparatus of the present invention is illustrated generally in FIGS. 4–40, with the indexed adhesive segment-laden carrier release tape used therein being illustrated in FIGS. 1–3. Specifically, the preferred embodiment of the present invention is focused upon the handheld mechanical adhesive segment applicator apparatus for dispensing indexed adhesive segment-laden carrier release tape, and the manufacture and construction thereof, as well as dispensing single adhesive segments therefrom in a manner facilitating the application of the adhesive segments to a surface. The preferred embodiment described herein also describes the operation of the handheld mechanical adhesive segment applicator apparatus to apply the indexed adhesive segments to desired surfaces. Finally, the detailed description of the preferred embodiment of the present invention also discloses the manufacture and construction of the indexed adhesive segment-laden carrier release tape used in the handheld mechanical adhesive segment applicator apparatus.

Referring first to FIG. 1, a plain stock roll 50 of differential release carrier release strip 52, having a first surface 54 and a second surface 56 opposite the first surface 54, is shown. The carrier release strip 52 may be made of paper that has a silicone release material on the first and second surfaces 54 and 56. The first surface 54 of the carrier release strip 52 has a coefficient of friction higher than the coefficient of friction of the second side 56 of the carrier release strip 52, so that the first surface of the carrier release strip 54 provides less release than does the second surface of the carrier release strip 52.

As shown in FIG. 1, the carrier release strip 52 is indexed in a process in which a plurality of mechanical reference indices are cut therein. Typically, the carrier release strip 52 is indexed to place a plurality of notches 58 therein by using a rotary die 60 which presses or strikes against the carrier release strip 52. An underlying anvil member 62 supports the carrier release strip 52 thereupon as it passes beneath the rotary die 60.

The rotary die 60 is typically drum-shaped, with a plurality of die blades 64 attached to the rotary die 60 around its outer circumference. In an assembly-line sequence, the rotary die 60 can easily be configured to cut a continuous and uniform stream of the indexing notches 58 in the carrier release strip 52, thereby resulting in an indexed carrier release strip which is identified by the reference numeral 66. The anvil member 62 used to support the carrier release strip 52 may be made of a hard material with recesses (not shown) located therein to receive the die blades 64 on the rotary die 60, or it may be a rotating member made either of hard material with such recesses or a resilient material which will absorb the die blades 64 of the rotary die 60.

A device called a "steel rule die" may be used instead of the rotary die 60 with the die blades 64 to create indexing notches 58 in the carrier release strip 52. A steel rule die normally consists of a member of a given length to which sharpened steel blades or dies of a given shape and location are affixed. Rubber pads are cemented along the die, allowing the entire assembly to be placed on top of the stock 50 and struck to produce indexing notches 58 in the carrier release strip 52. It will be appreciated that the construction and operation of the rotary die 60 with the die blades 64 and the anvil member 62 as well as alternate mechanisms for cutting the indexing notches 58 are well known to those skilled in the art.

Note that two laterally adjacent pairs of indexing notches 58 are placed in the carrier release strip 52. This is because the operation illustrated in FIG. 1 is used to make two rolls of the indexed adhesive segment-laden carrier release tape simultaneously. It should also be noted that a single roll of indexed adhesive segment-laden carrier release tape could instead be made, or, alternatively more than two rolls can simultaneously be made without departing from the principles taught by the present invention.

After having the indexing notches 58 cut into the carrier release strip 52, the indexed carrier release strip 66 passes through, and is tensioned by, a pair of opposing rollers 68 and 70. The opposing rollers 68 and 70 ensure that the indexed carrier release strip 66 remains taut during the metering of molten adhesive material thereupon. Once the indexed carrier release strip 66 enters the adhesive metering stage, a very precise servo-driven motor (not shown) signals two dispensing nozzles 72 to administer molten adhesive segments 74 of adhesive material upon the first surface 54 of the indexed carrier release strip 66 at locations which are precisely located and spaced at precise intervals, thereby creating an indexed, adhesive segment-laden carrier release strip which is identified by the reference numeral 76. The adhesive material used is preferably a hot melt thermoplastic adhesive material, although other types of adhesive and methods of applying it could instead be used. In the embodiment illustrated herein, two laterally adjacent rows of molten adhesive segments 74 have been placed upon the indexed adhesive segment-laden carrier release strip 76, since two rolls of indexed adhesive segment-laden carrier release tape are being made in the manufacturing operation illustrated herein.

The molten adhesive segments 74 are dispensed at extremely accurate intervals, thereby ensuring precise placement with respect to each lateral pair of indexing notches 58 on the indexed carrier release strip 66. Alternatively, although not illustrated in FIG. 1, an optical sensor may also be used to control the dispensing of the molten adhesive segments 74 upon the indexed carrier release strip 66. In this case, after detecting an indexed notch 58, an optical sensor would be used to trigger the dispensing nozzles 72 to administer molten adhesive segments 74 onto the indexed carrier release strip 66 at an appropriate position with respect to the indexing notches 58. Note that although the molten adhesive segments 74 are shown to be located longitudinally intermediate lateral pairs of indexing notches 58, it is only necessary that they are in a predetermined longitudinal position with respect to the lateral pairs of indexing notches 58.

After metering the molten adhesive segments 74 onto the indexed carrier release strip 66, the indexed, adhesive segment-laden carrier release strip 76 advances to the individual tape strip formation stage. Here, a cutter 78 is used to slit the indexed, adhesive segment-laden carrier release strip 76 into two individual strips of indexed adhesive segment-laden carrier release tape which are each identified by the reference numeral 80. It will, of course be appreciated by those skilled in the art that a single individual strip or more than two strips could instead be made with FIG. 1 illustrating an example of the manufacturing process rather than representing a limitation as to the number of strips which may be manufactured.

In addition to applying the molten adhesive segments 74 to the indexed carrier release strip 66 and using the cutter 78 to separate the indexed, adhesive segment-laden carrier release strip 76 into the two indexed adhesive segment-laden carrier release tapes 80, the molten adhesive segments 74 on the indexed adhesive segment-laden carrier release tapes 80 must be formed into dispensable adhesive segments, typically by flattening the molten adhesive segments 74 before they cool. The molten adhesive segments 74 may be flattened into dispensable adhesive segments in a variety of ways.

First, as illustrated in FIG. 1, dispensable adhesive segments may be formed by rolling the indexed, adhesive segment-laden carrier release strip 76 to form two rolls of tape 82 while the molten adhesive segments 74 are still hot. In doing so, the molten adhesive segments 74 present on the first side 54 of the carrier release strip 52 will be flattened against the second side 56 (i.e. the back side) of the carrier release strip 52, thereby forming the dispensable adhesive segments. The tightness, or tension, of the tape roll 82 as it is wound can be used to vary the thickness of the dispensable adhesive segments. Thus, by controlling the tension of the tape roll 82, along with the cooling rate of the molten adhesive segments 74, the thickness of the dispensable adhesive segments on the tape roll 82 may be varied.

While not illustrated in FIG. 1, it is also contemplated that the molten adhesive segments 74 may be flattened by running them through a mechanical compressing mechanism (not shown), such as a pair of opposing rollers. In such an embodiment, it is envisioned that the roller contacting the molten adhesive segments 74 would have a surface with a coefficient of friction low enough to prevent the molten adhesive segments 74 from sticking to the roller.

Referring now to FIG. 2, the tape roll 82 of the indexed adhesive segment-laden carrier release tape 80 is illustrated with a plurality of dispensable adhesive segments 84 contained thereon. It will be appreciated by those skilled in the art that the indexed adhesive segment-laden carrier release tape 80 of the present invention, like the carrier release strip 52 from which it is formed, has the first surface 54 and the second surface 56, which have different coefficients of friction. As mentioned above, the first surface 54 of the carrier release strip 52 from which the indexed adhesive segment-laden carrier release tape 80 is made has a coefficient of friction higher than that of the second surface 56 of the carrier release strip 52. This allows the indexed adhesive segment-laden carrier release tape 80 to be unrolled with the dispensable adhesive segments 84 sticking to the first surface 54 rather than to the second surface 56.

Referring now to FIG. 3, the preferred embodiment of the indexing notches 58 and their position with respect to the dispensable adhesive segments 84 is shown in detail. While the rotary die 60 may create any of a wide variety of patterns in the carrier release strip 52, the indexing notches 58 of the preferred embodiment are of a wide V-shaped configuration, with pairs of indexing notches 58 being spaced apart and oriented so that the points of each of the V's in each pair are directed toward opposing edges 86 and 88 of the indexed adhesive segment-laden carrier release tape 80. The open tops of the V's of each pair of the indexing notches 58 thus are oriented toward each other, with much of the transverse width of the indexed adhesive segment-laden carrier release tape 80 being located therebetween.

It may be seen that the indexed adhesive segment-laden carrier release tape 80 is wound onto a hollow cylindrical core 90, which may be, for example, made of cardboard or the like. The inside of the core 90 has two identically-shaped orientation facilitating segments 92 and 94 mounted therein. The orientation facilitating segments 92 and 94 will be used to facilitate the installation of the tape roll 82 onto a supply spool (to be discussed below in conjunction with FIG. 24) in the proper orientation. Due to the presence and configuration of the orientation facilitating segments 92 and 94 on the inside of the core 90, it will be impossible to place the tape roll 82 onto the supply spool backwards.

While a notch design as taught by the present invention is preferred, other patterns may instead be used so long as they are capable of providing a mechanism to allow the carrier release strip 52 to mate with an advancement mechanism of a desired adhesive segment applicator apparatus (not shown in FIG. 3). In addition, while the dispensable adhesive segments 84 are located intermediate adjacent pairs of the indexing notches 58, they could be located with a different orientation, such as, for example, between the indexing notches 58 in each pair. Instead of indexing notches 58, perforations could be made in the carrier release strip 52. Such perforations could be of the same shape as the notches 58, or any other shape such as square, rectangular, or circular instead. They could be located in the carrier release strip 52 in the same location as the notches 58, or in the opposing edges 86 and 88 of the indexed adhesive segment-laden carrier release tape 80. Such variations are certainly within the scope of the present invention.

The dispensable adhesive segments 84 are in the preferred embodiment a hot melt thermoplastic adhesive. They may come in various "tack" levels, or degrees of stickiness, such as low tack, medium tack, high tack, and super high tack. In addition, the dispensable adhesive segments 84 may also come in various thicknesses, such as, for example, low (approximately one-sixty-fourth of an inch thick), medium (approximately one-sixteenth of an inch thick), and high (approximately one-eighth of an inch thick). They may also come in various shapes, such as the circular shape illustrated in FIG. 3, as well as lines, squares, rectangles, triangles, and any other geometric shaped which is desired. The indexing notches 58 may be spaced to accommodate any of these shapes. They may be neutral in color, or they may be tinted in any desired color.

Figure 5:
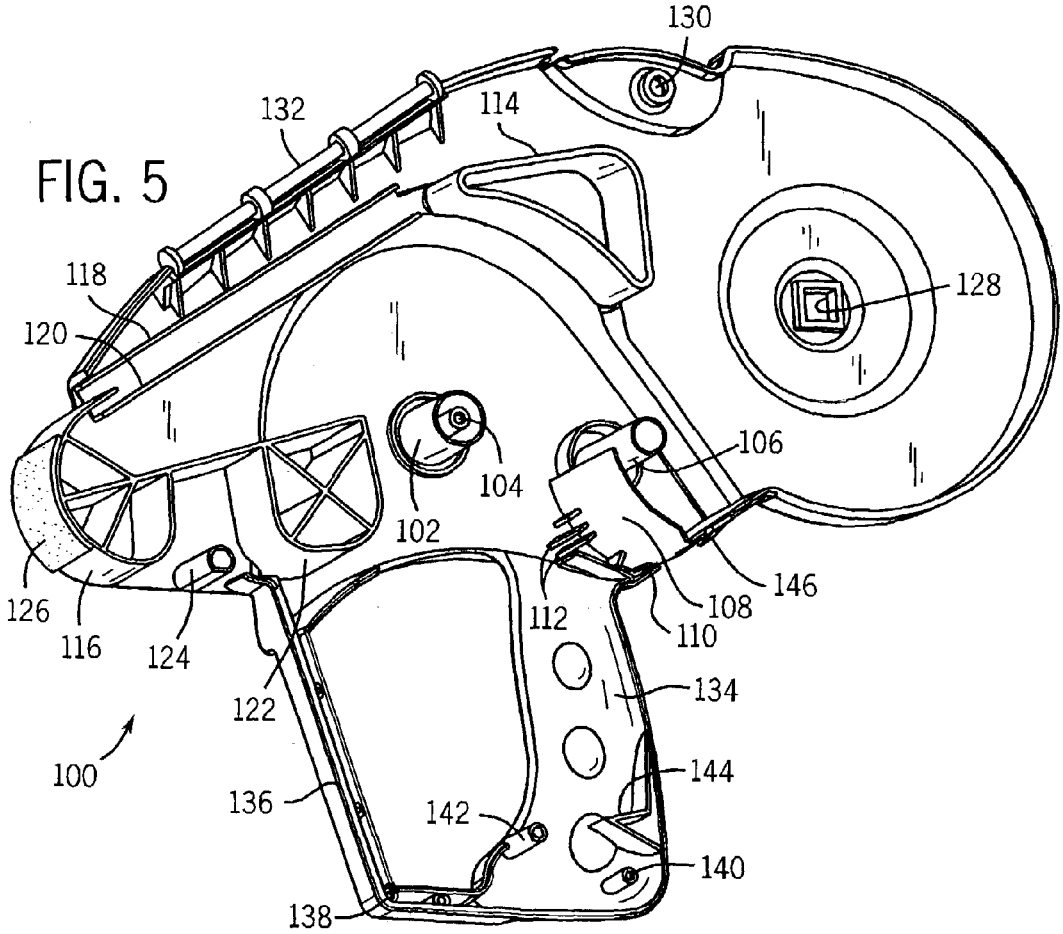
FIG. 5 is an isometric view of the inside of the right housing member illustrated in FIG. 4.

Referring next to FIGS. 4 and 5, a right housing member 100 for the handheld mechanical adhesive segment applicator apparatus of the present invention is illustrated. The right housing member 100 may be thought of as having four portions: 1. a central portion which will house the mechanism for advancing the indexed adhesive segment-laden carrier release tape 60 therethrough; 2. a forward portion resembling a triangle with its forwardmost corner rounded to serve as an application point from which the dispensable adhesive segments 84 are dispensed; 3. a rearward portion which is approximately circular and which serves as a storage reservoir for the tape roll 82; and 4. a lower portion including a handle. The forward portion, the rearward portion, and the lower portion all extend from the central portion. In the preferred embodiment, the right housing member 100 may be molded from plastic material.

Referring first to the central portion of the right housing member 100, a cylindrical mounting post 102 (which will support a circular feed member to be discussed below in conjunction with FIGS. 10 through 12) extends orthogonally from the central area thereof on the interior of the right housing member 100. Located in the center of the mounting post 102 is a screw hole 104. Located rearwardly (toward the circular portion from the mounting post 102 and slightly below the level of the mounting post 102) is a cylindrical pivot post 106 (which will support a feed mechanism member to be discussed below in conjunction with FIGS. 20 and 21), which also extends orthogonally from the interior of the right housing member 100.

Located in front of the pivot post 106 is a tape guide 108 which also extends orthogonally from the interior of the right housing member 100. The tape guide 108 is slightly curved and communicates with the edge rear of a notch 110 in the bottom of the central area of the right housing member 100. The notch 110 is where waste carrier release tape (not shown in FIG. 4 or 5) will exit the handheld mechanical adhesive segment applicator apparatus. Located forward of the tape guide 108 are two mounting posts 112 which extend orthogonally from the interior of the right housing member 100. The mounting posts 112 will be used to mount another element of the handheld mechanical adhesive segment applicator apparatus which will be discussed below in conjunction with FIGS. 22 and 23.

Located near the rear of the central portion of the right housing member 100 above and to the rear of where the circular feed member mounted on the mounting post 102 will be installed is a tape guide surface 114 which will support carrier release tape (not shown in FIG. 4 or 5) thereupon. The tape guide surface 114 extends orthogonally from the interior of the right housing member 100. Located at the front of the forward portion of the right housing member 100 is a C-shaped tape guide surface 116 which will also support carrier release tape thereupon. The C-shaped tape guide surface 116 extends orthogonally from the interior of the right housing member 100.

Located in the central and forward portions of the right housing member 100 intermediate the tape guide surface 114 and the C-shaped tape guide surface 116 are two spaced-apart guide members 118 and 120 which extend orthogonally from the interior of the right housing member 100. The guide member 118 is located above the guide member 120, with the guide members 118 and 120 defining a channel for an edge of the indexed adhesive segment-laden carrier release tape 80 (not shown in FIGS. 4 and 5) which extends between the tape guide surface 114 and the C-shaped tape guide surface 116. The guide members 118 and 120 are sufficiently shallow to prevent the guide member 118 from contacting any dispensable adhesive segments 84 (also not shown in FIGS. 4 and 5) contained on the indexed adhesive segment-laden carrier release tape 80.

Located intermediate the front and central portions of the right housing member 100 above and to the rear of where the circular feed member mounted on the mounting post 102 will be installed is a U-shaped tape guide surface 122. The U-shaped tape guide surface 122 extends orthogonally from the interior of the right housing member 100. Located intermediate the bottom surfaces of the C-shaped tape guide surface 116 and the U-shaped tape guide surface 122 is a support post 124 which extends orthogonally from the interior of the right housing member 100. The support post 124 will be used to mount another element of the handheld mechanical adhesive segment applicator apparatus which will be discussed below in conjunction with FIG. 25.

Mounted on the C-shaped tape guide surface 116 at the front thereof is a thin foam strip 126 which will act as a cushion on the nose of the handheld mechanical adhesive segment applicator apparatus. The foam strip 126 is made of a foam strip with a nonstick surface. In the preferred embodiment, this foam strip 126 can be between one-sixteenth of an inch thick and one-half of an inch thick, with a one-eighth inch thickness being preferred. Also in the preferred embodiment, the nonstick surface is provided by a thin (10 mil thick) strip of tape made of a durable material having a very low coefficient of friction such as, for example, a fluoropolymer such as polytetrafluoroethylene ("PTFE"), such as the material marketed by DuPont under the trademark TEFLON, the strip of tape being adhesively secured to the outwardly facing surface of the foam strip 126. Alternatively, ultra-high molecular weight ("UHMW") polyethylene could be used instead of PTFE. This nonstick surface minimizes the drag that is created when the indexed adhesive segment-laden carrier release tape 80 (not shown in FIGS. 4 and 5) is pulled around the sharp curve of the nose of the handheld mechanical adhesive segment applicator apparatus.

Located in the center of the circular rearward portion of the right housing member 100 is a square aperture 128 which will be used to mount the tape roll 82 (not shown in FIGS. 4 and 5). Located near the top of the right housing member 100 intermediate the central and rearward portions thereof is an aperture 130 which may be used to allow the handheld mechanical adhesive segment applicator apparatus to be hung on a hook or the like for storage purposes, or to allow the weight of the device to be supported by a tool balancer. A right hinge half 132 is mounted on the right housing member 100 along the top of the central portion thereof.

The lower portion of the right housing member 100 includes a right handle half 134 at the rear of the lower portion of the right housing member 100. An L-shaped right trigger guard half 136 extends from the bottom of the right handle half 134 and forwardly, and then upwardly to a location intermediate the central and forward portions of the right housing member 100 at the bottoms thereof. Located in the interior of the right trigger guard half 136 at the intersection of the base of the "L" and the leg of the "L" is a screw hole 138. Located in the interior of the right handle half 134 near the bottom and rear thereof is a screw hole 140.

Located in the interior of the right handle half 134 and extending orthogonally therefrom is a pivot post 142, which will be used to mount an actuator (which will be discussed below in conjunction with FIGS. 17 and 18) used to advance the indexed adhesive segment-laden carrier release tape 80 (not shown in FIGS. 4 and 5). Also located in the interior of the right handle half 134 is a right bearing surface half 144 which will support an end of a biasing mechanism (to be discussed below in conjunction with FIG. 19) used to bias the actuator into a first position. A latching member 146 is located on the bottom of the central portion of the right housing member 100 behind the tape guide 108.

Figure 6:
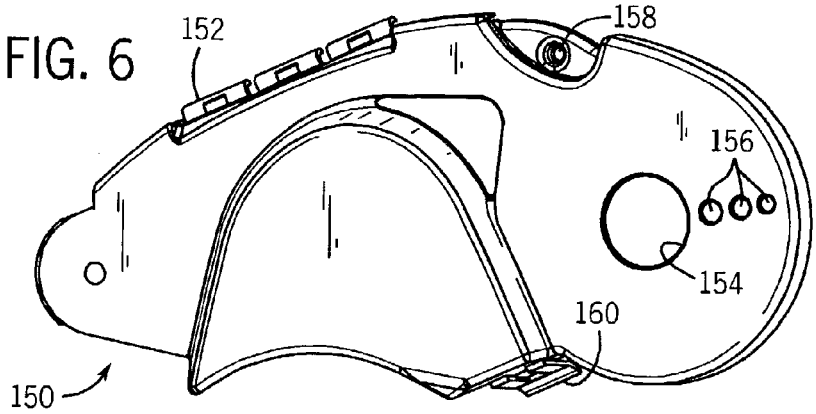
FIG. 6 is a plan view of the outside of a housing door member which will be hingedly mounted on the right housing member illustrated in FIGS. 4 and 5.
Figure 7:
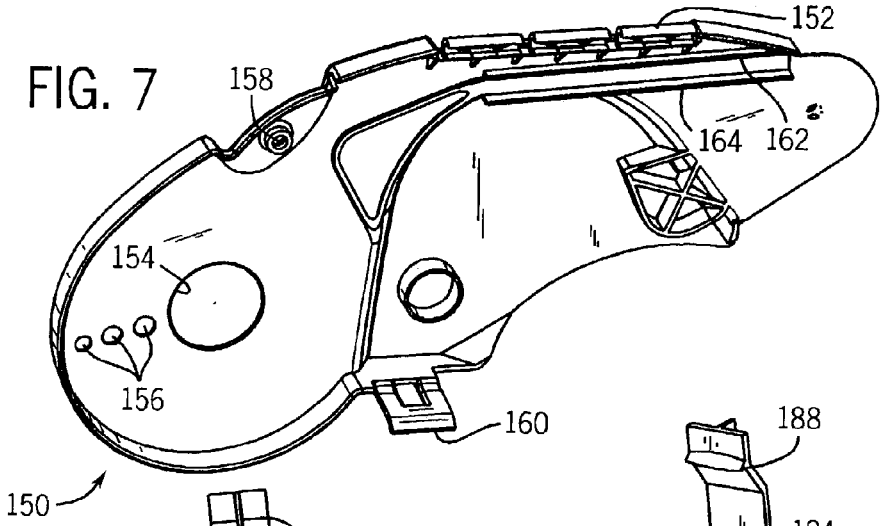
FIG. 7 is an isometric view of the inside of the housing door member illustrated in FIG. 6.

Turning now to FIGS. 6 and 7, a housing door member 150 is illustrated. The housing door member 150 will form much of the left half of the housing of the handheld mechanical adhesive segment applicator apparatus of the present invention, and includes central, forward, and rearward portions which correspond to the central, forward, and rearward portions of the right housing member 100 (shown in FIGS. 4 and 5). The housing door member 150 includes a left hinge half 152 mounted on the housing door member 150 along the top of the central portion thereof. The left hinge half 152 will mate with the right hinge half 132 of the right housing member 100 to allow the housing door member 150 to swing upwardly to expose the interior of the handheld mechanical adhesive segment applicator apparatus. In the preferred embodiment, the housing door member 150 may be molded from plastic material.

The housing door member 150 has a large aperture 154 located in the center of the circular rearward portion thereof which large aperture 154 will be aligned with the square aperture 128 in the right housing member 100 when the housing door member 150 is closed. The large aperture 154 will be used to access a mechanism (which will be discussed below in conjunction with FIG. 26) used to adjust the tension on a tape roll 82 (not shown in FIGS. 6 and 7). A series of three smaller apertures 156 are located rearwardly of the large aperture 154, and will be used to view how much the indexed adhesive segment-laden carrier release tape 80 (not shown in FIGS. 6 and 7) is remaining on a tape roll 82 in the handheld mechanical adhesive segment applicator apparatus.

Located near the top of the housing door member 150 intermediate the central and rearward portions thereof is an aperture 158 which may be used to allow the handheld mechanical adhesive segment applicator apparatus to be hung on a hook or the like for storage purposes, or to allow the weight of the device to be supported by a tool balancer. When the housing door member 150 is closed, the aperture 158 in the housing door member 150 will be aligned with the aperture 130 in the right housing member 100. Located on the bottom of the central portion of the housing door member 150 is a latching member 160. When the housing door member 150 is closed on the right housing member 100, the latching member 160 will cooperate with the latching member 146 on the right housing member 100 (best shown in FIG. 5) to keep the housing door member 150 closed.

Located in the central and forward portions of the housing door member 150 are two spaced-apart guide members 162 and 164 which extend orthogonally from the interior of the housing door member 150. The guide member 162 is located above the guide member 164, with the guide members 162 and 164 being aligned with the guide members 118 and 120, respectively, in the right housing member 100 (shown in FIG. 5). The guide members 162 and 164 define a channel for an edge of the indexed adhesive segment-laden carrier release tape 80 (not shown in FIGS. 6 and 7). The guide members 162 and 164 are sufficiently shallow to prevent the guide member 162 from contacting any dispensable adhesive segments 84 (also not shown in FIGS. 6 and 7) contained on the indexed adhesive segment-laden carrier release tape 80.

Figure 8:
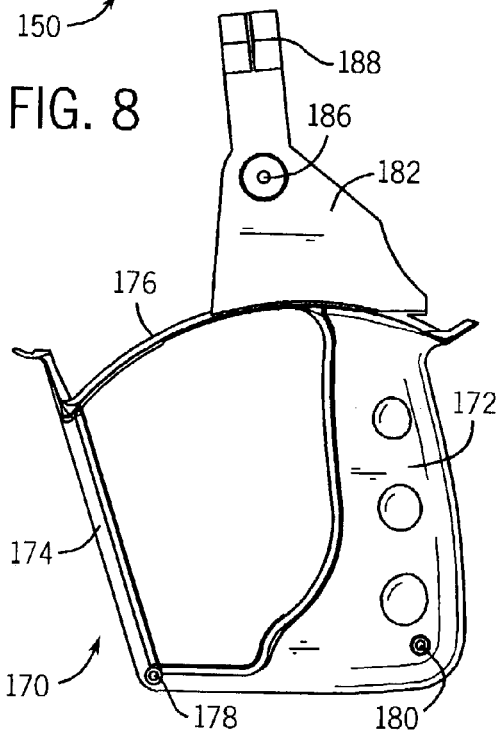
FIG. 8 is a plan view of the outside of a handle housing member which will be mounted on corresponding structure on the right housing member illustrated in FIGS. 4 and 5.
Figure 9:
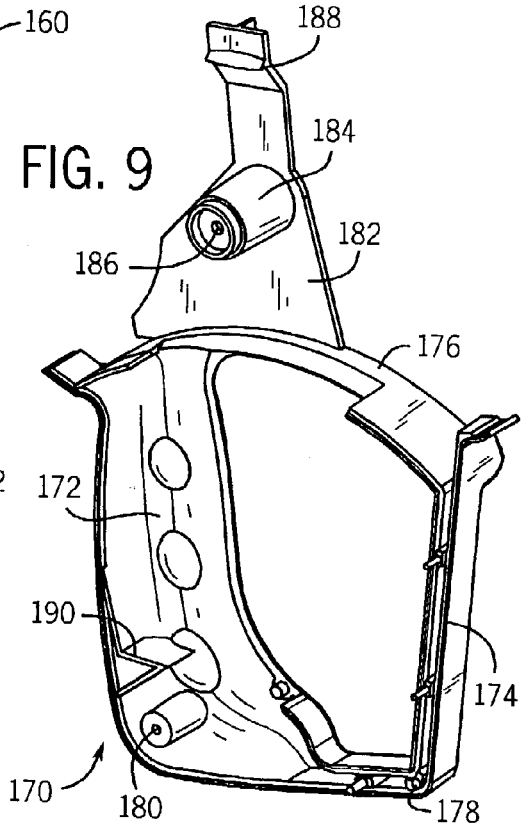
FIG. 9 is an isometric view of the inside of the handle housing member illustrated in FIG. 8.

Referring next to FIGS. 8 and 9, a handle housing member 170 is illustrated. The handle housing member 170 will form the balance of the left half of the housing of the handheld mechanical adhesive segment applicator apparatus of the present invention, and corresponds to the lower portion of the right housing member 100 (shown in FIGS. 4 and 5). In the preferred embodiment, the handle housing member 170 may be molded from plastic material. The handle housing member 170 includes a left handle half 172 at the rear thereof. An L-shaped left trigger guard half 174 extends from the bottom of the left handle half 172 and forwardly, and then upwardly. The top ends of the left trigger guard half 174 and the left handle half 172 are connected by an arcuate segment 176.

Located in the handle housing member 170 at the intersection of the base of the "L" and the leg of the "L" is a screw hole 178. Located in the handle housing member 170 near the bottom and rear thereof is a screw hole 180. When the handle housing member 170 is mounted onto the lower portion of the right housing member 100 (shown in FIGS. 4 and 5), the screw hole 178 and the screw hole 180 in the handle housing member 170 will be aligned with the screw hole 138 and the screw hole 140 (both of which are shown in FIG. 5), respectively, in the right housing member 100.

Extending upwardly from the arcuate segment 176 above the front of the left handle half 172 is a retaining flange 182. The retaining flange 182 will retain a circular feed member (to be discussed below in conjunction with FIGS. 10 through 12) on the mounting post 102 on the right housing member 100 (shown in FIG. 5). The retaining flange 182 has a mounting post 184 extending orthogonally from the side thereof which will face the right housing member 100 when the handle housing member 170 is mounted on the right housing member 100. The mounting post 184 will be aligned with the mounting post 102 in the right housing member 100 (shown in FIG. 5) when the handle housing member 170 is mounted on the right housing member 100. Extending through the retaining flange 182 and the mounting post 184 is a screw hole 186, which will be aligned with the screw hole 104 in the mounting post 102 in the right housing member 100 when the handle housing member 170 is mounted on the right housing member 100.

Located at the distal end of the retaining flange 182 is a retaining latch 188 which will be used to retain a feed mechanism member (which will be discussed below in conjunction with FIGS. 20 and 21) in place. Located in the interior of the left handle half 172 is a left bearing surface half 190 which will support an end of a biasing mechanism (which will be discussed below in conjunction with FIG. 19) used to bias an actuator (which will be discussed below in conjunction with FIGS. 17 and 18) into a first position. The left bearing surface half 190 in the left handle half 172 will be aligned with the right bearing surface half 144 in the right handle half 134 when the handle housing member 170 is mounted on the right housing member 100.

Figure 10:
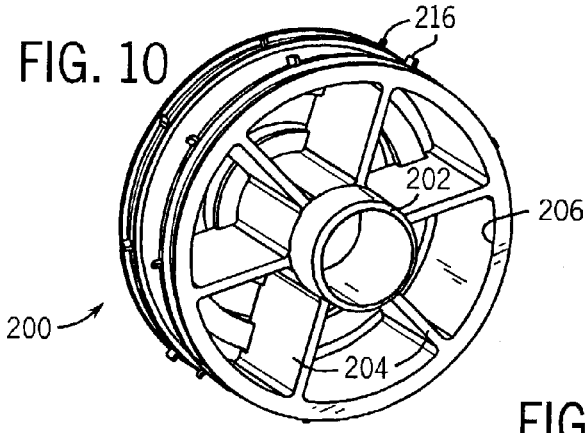
FIG. 10 is an isometric view of a tape feed wheel from the right side thereof.
Figure 11:
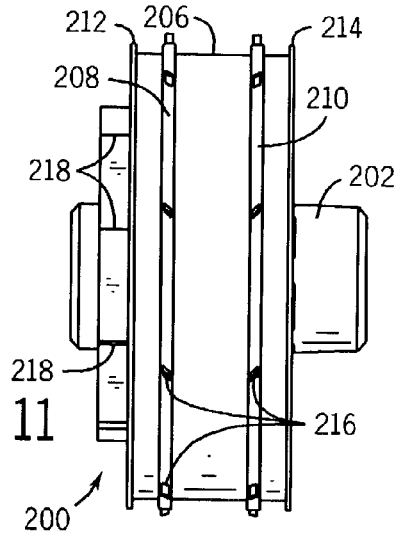
FIG. 11 is a side view of the tape feed wheel illustrated in FIG. 10.
Figure 12:
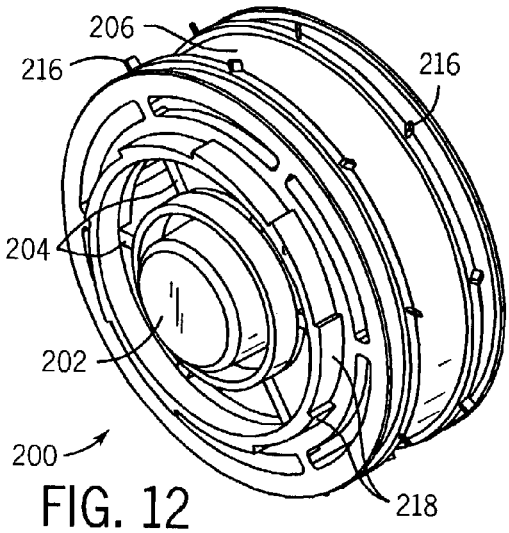
FIG. 12 is an isometric view of the tape feed wheel illustrated in FIGS. 10 and 11 from the left side thereof.

Referring now to FIGS. 10 through 12, a tape feed wheel 200 is illustrated which will be used to advance the indexed adhesive segment-laden carrier release tape 80 (not shown in FIGS. 10 through 12) through the handheld mechanical adhesive segment applicator apparatus. In the preferred embodiment, the tape feed wheel 200 may be molded from plastic material. The tape feed wheel 200 is based upon a hollow cylindrical hub 202 which will be used to rotationally mount the tape feed wheel 200. Six spokes 204 extend radially outwardly from the cylindrical hub 202, and support a hollow cylindrical drive wheel 206 which is concentric with the cylindrical hub 202.

Mounted on the outer diameter of the cylindrical drive wheel 206 in a spaced-apart relationship are two annular ridges 208 and 210 which extend radially outwardly from the outer surface of the cylindrical drive wheel 206. The annular ridges 208 and 210 are each spaced away from an edge of the cylindrical drive wheel 206. Extending radially outwardly from the respective edges of the cylindrical drive wheel 206 are annular flanges 212 and 214. The annular flanges 212 and 214 extend outwardly further from the outer surface of the cylindrical drive wheel 206 than do the annular ridges 208 and 210.

Mounted on each of the annular ridges 208 and 210 are a plurality of angled teeth 216 arranged in laterally adjacent pairs around the periphery of annular ridges 208 and 210. The teeth 216 extend outwardly from the annular ridges 208 and 210. The spacing between annular ridges 208 and 210 and each laterally adjacent pair of teeth 216 is identical to the spacing between laterally adjacent pairs of the indexing notches 58 on the indexed adhesive segment-laden carrier release tape 80 (shown in FIGS. 1 through 3). Similarly, the spacing between rotationally adjacent teeth 216 is the same as the spacing between longitudinally adjacent indexing notches 58 on the indexed adhesive segment-laden carrier release tape 80.

The size and configuration of the teeth 216 are designed to fit into the indexing notches 58 in the indexed adhesive segment-laden carrier release tape 380 to allow the indexed adhesive segment-laden carrier release tape 380 to be moved by using the tape feed wheel 200. The annular flanges 212 and 214 are spaced apart sufficiently to comfortable accommodate the width of the indexed adhesive segment-laden carrier release tape 380. In addition, the annular ridges 208 and 210 are spaced intermediate the annular flanges 212 and 214 to allow the tape feed weel 200 to fully engage a portion of the indexed adhesive segment-laden carrier release tape 380 which is partially wrapped around the tape feed wheel 200.

Extending from the side of the tape feed wheel 200 from which the annular flange 212 extends is an annular series of drive teeth 218. The drive teeth 218 are designed to turn the tape feed wheel 200 in a clockwise direction (as viewed from the side of the tape feed wheel 200 upon which the drive teeth 218 are mounted). The drive teeth 218 are indexed to the adjacent pairs of the teeth 216, meaning that there are the same number of drive teeth 218 as there are adjacent pairs of teeth 216. The drive teeth 218 include a series of ramps therebetween, extending from the base of the previous tooth 216 to the top of the next tooth 216. Thus, the teeth 216 each extend in a radially outwardly direction, with ramps therebetween.

Figure 13:
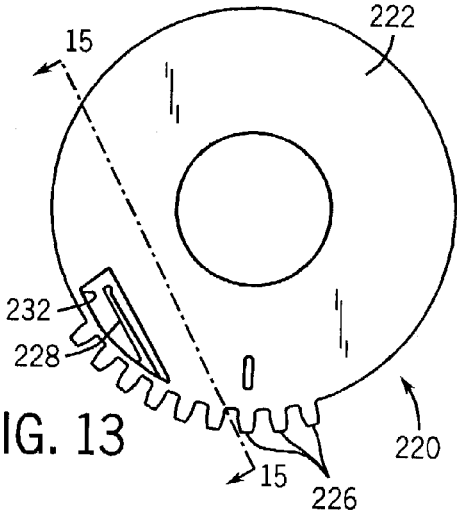
FIG. 13 is a plan view of a pawl gear from the left side thereof.
Figure 14:
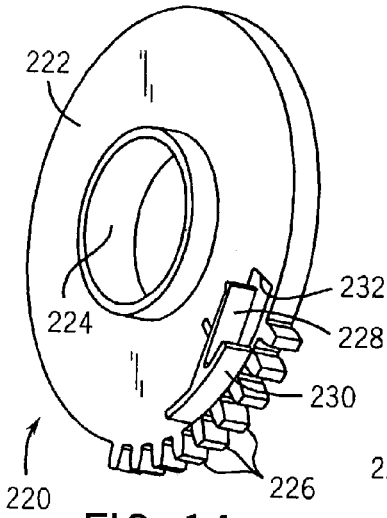
FIG. 14 is an isometric view of the pawl gear illustrated in FIG. 13 from the right side thereof.
Figure 15:
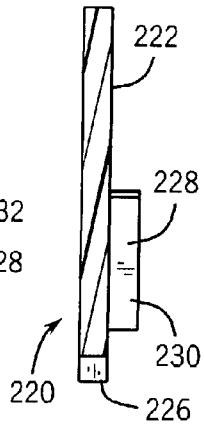
FIG. 15 is a cross-sectional view of the pawl gear illustrated in FIGS. 13 and 14.

Turning next to FIGS. 13 through 15, a pawl gear 220 is illustrated which will be used to drive the tape feed wheel 200 (best shown in FIG. 12). In the preferred embodiment, the pawl gear 220 may be molded from plastic material. The pawl gear 220 has a flat, washer-shaped (circular with a hole in the center) disc 222 which is mounted on a hollow cylindrical segment 224. The cylindrical segment 224 extends from only one side of the disc 222 (the right side, which is shown in FIG. 14). The inner diameter of the hole in the disc 222 and the interior of the cylindrical segment 224 is sized to fit freely upon the cylindrical hub 202 of the tape feed wheel 200. The pawl gear 220 has a number of teeth 226 which extend radially outwardly from the outer edge of the disc 222 for something less than a ninety degree arc. The teeth 226 will be used to drive the pawl gear 220.

Located on the back side of the pawl gear 220 is a drive pawl 228 which is mounted on the inside of the disc 222. The drive pawl 228 has one end thereof mounted on an arcuate flange 230, which extends orthogonally from the inside of the disc 222 at the outer edge thereof, adjacent several of the teeth 226. The drive pawl 228 extends at an angle approximately orthogonal to a radius of the pawl gear 220, and is sufficiently thin to allow it to flex. The disc 222 has an aperture 232 located therein surrounding the drive pawl 228 (as best shown in FIG. 13), which aperture 232 is used to facilitate the manufacture of the pawl gear 220 by molding. The distal (free) end of the drive pawl 228, which is the end thereof which extends radially inwardly the furthest, is located at a radius typically equal to (or slightly less than) the radius of the bottom of each of the drive teeth 218 on the tape feed wheel 200 shown in FIG. 12). In operation, the side of the pawl gear 220 on which the drive pawl 228 is mounted will face the side of the tape feed wheel 200 on which the drive teeth 218 are mounted (as will become evident in the discussion which follows in conjunction with FIG. 26).

Figure 16:
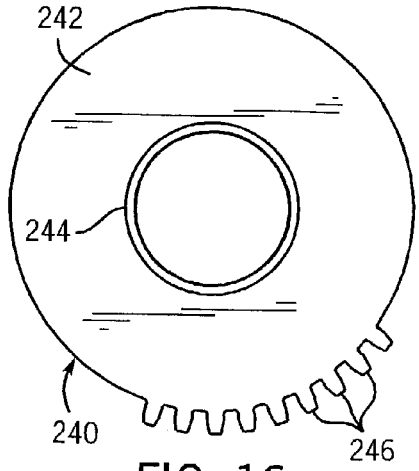
FIG. 16 is a plan view of a geared spacer from the left side thereof.

Turning now to FIG. 16, a geared spacer 240 is illustrated which will be used on the back side of the pawl gear 220 (best shown in FIG. 10). In the preferred embodiment, the geared spacer 240 may be molded from plastic material. The geared spacer 240 has a flat, washer-shaped (circular with a hole in the center) disc 242 which is mounted on a hollow cylindrical segment 244. The cylindrical segment 244 extends from only one side of the disc 242 (the left side, which is shown in FIG. 16). The inner diameter of the hole in the disc 242 and the interior of the cylindrical segment 244 is sized to fit freely upon the cylindrical hub 202 of the tape feed wheel 200. The geared spacer 240 has a number of teeth 246 which are identical in size, pitch, and number to the teeth 226 on the pawl gear 220. The geared spacer 240 is flat, and unlike the pawl gear 220 has no pawl mounted thereupon.

Figure 17:
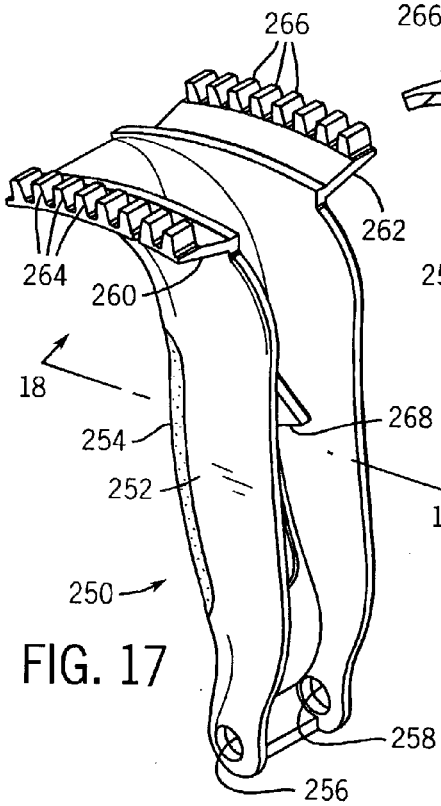
FIG. 17 is an isometric view of a trigger member from the left side and rear thereof.
Figure 18:
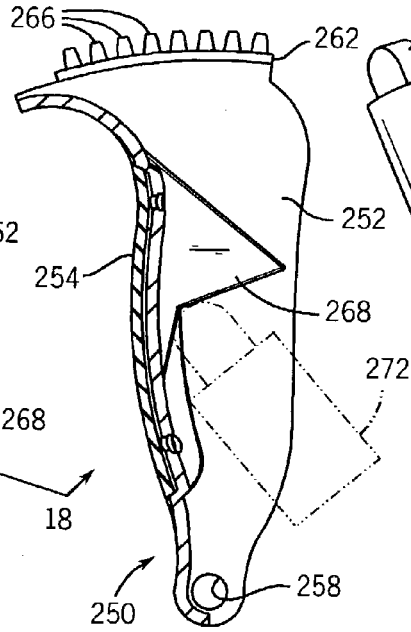
FIG. 18 is a cross-sectional view of the trigger member illustrated in FIG. 17.

Moving next to FIGS. 17 and the retaining latch 188; a trigger member 250 is illustrated which will be used to engage the pawl gear 220 (best shown in FIGS. 13 and 14 and the geared spacer 240 (shown in FIG. 16). The trigger member 250 has a hollow trigger housing 252 which is enclosed at the front and sides thereof. In the preferred embodiment, the trigger housing 252 may be molded from plastic material. The front of the trigger housing 252 is configured to be gripped by the four fingers of the hand, and has a grip insert 254 located on the front side thereof. The grip insert 254 may be made of rubber or any other suitable material providing a good and comfortable gripping surface.

The side walls of the trigger housing 252 have corresponding apertures 256 and 258 located near the bottom thereof which apertures 256 and 258 will be used to pivotally mount the trigger member 250 (as will become evident below in conjunction with a discussion of FIG. 26). Extending outwardly from the left side of the trigger housing 252 at the top thereof is an arcuate flange 260, and extending outwardly from the right side of the trigger housing 252 at the top thereof is an arcuate flange 262. Located on the top of the arcuate flange 260 are a plurality of upwardly projecting teeth 264, and located at the top of the arcuate flange 262 are a plurality of upwardly projecting teeth 266.

The teeth 264 on the trigger member 250 will engage the teeth 226 on the pawl gear 220 (best shown in FIGS. 13 and 14), and the teeth 266 on the trigger member 250 will engage the teeth 246 on the geared spacer 240 (shown in FIG. 16). Located inside the hollow interior of the trigger housing 252 is a bearing surface 268 which will support an end of a biasing mechanism (to be discussed below in conjunction with FIG. 19) used to bias the trigger member 250 into a first position.

Figure 19:
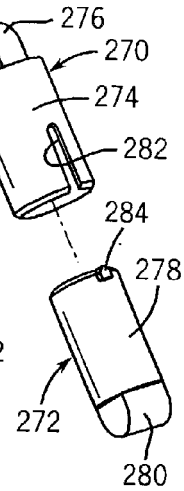
FIG. 19 is an exploded view of upper and lower spring housing members showing how they will fit together.

Turning now to FIG. 19, two elements of that biasing mechanism are illustrated, namely, an upper spring housing member 270 and a lower spring housing member 272. In the preferred embodiment, both the upper spring housing member 270 and the lower spring housing member 272 may be molded from plastic material. The upper spring housing member 270 consists of a hollow cylindrical housing 274 which is open on the bottom end thereof and has a rounded bearing end 276 located on the closed top end thereof. The lower spring housing member 272 consists of a hollow cylindrical housing 278 which is open on the top end thereof and has a rounded bearing end 280 located on the closed bottom end thereof. The outer diameter of the cylindrical housing 278 of the lower spring housing member 272 is of a size such that it can fit freely into the interior of the cylindrical housing 274 of the upper spring housing member 270.

The cylindrical housing 274 has a longitudinally oriented slot 282 located therein which communicates with the bottom end of the cylindrical housing 274. Located on the outside surface of the cylindrical housing 278 near the top end thereof is an outwardly extending projection 284 which will fit into the slot 282 in the cylindrical housing 274 in a sliding relationship. The projection 284 in the upper spring housing member 270 and the slot 282 in the lower spring housing member 272 ensure that the rounded bearing end 276 on the upper spring housing member 270 and the rounded bearing end 280 on the lower spring housing member 272 will be aligned with respect to each other. A spring (not shown in FIG. 19) will be mounted within the compartment defined by the interiors of the cylindrical housing 274 and the cylindrical housing 278.

Figure 20:
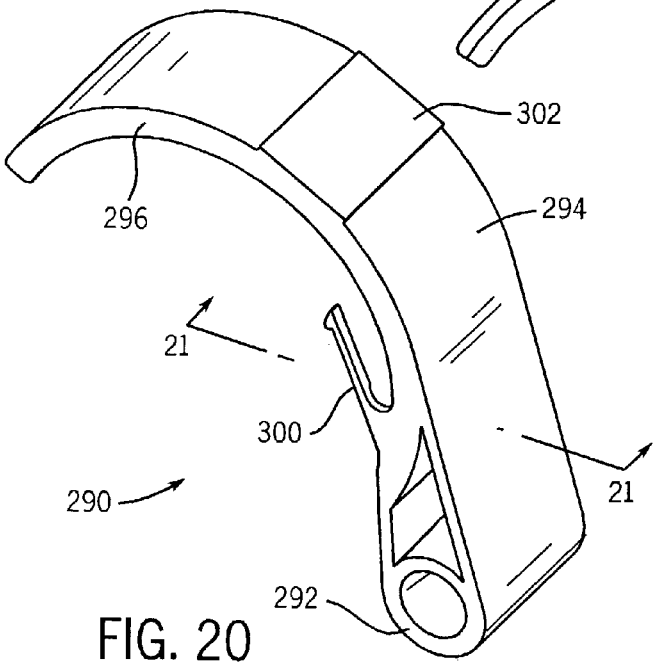
FIG. 20 is an isometric view from the left side of a pawl cuff member which will retain carrier release tape in place on the tape feed wheel illustrated in FIGS. 10 through 12.
Figure 21:
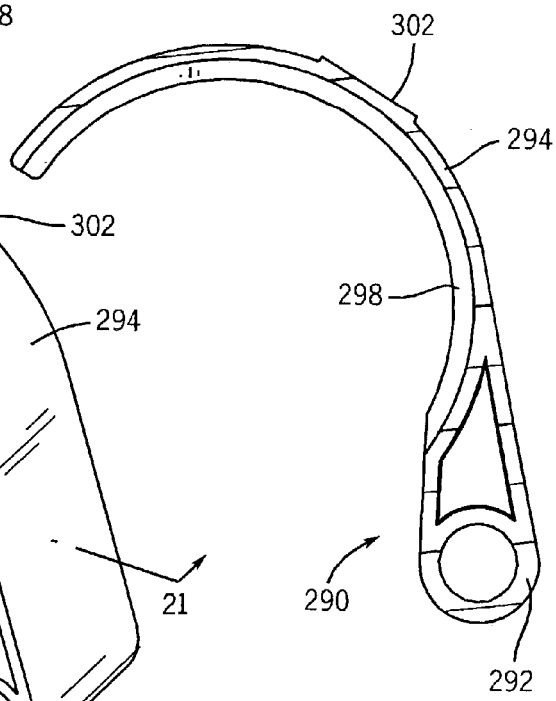
FIG. 21 is a cross-sectional view of the pawl cuff member illustrated in FIG. 20.

Moving next to FIGS. 20 and 21, a pawl cuff member 290 is illustrated which will overlie a portion of the tape feed wheel 200 (shown in FIGS. 10 through 12) to retain a segment of the indexed adhesive segment-laden carrier release tape 80 (best shown in FIGS. 2 and 3) engaged by the teeth 216 on the tape feed wheel 200. In the preferred embodiment, the pawl cuff member 290 may be molded from plastic material. The pawl cuff member 290 has a hollow cylindrical mounting segment 292 located at one end thereof. Extending from the cylindrical mounting segment 292 is an arcuate surface 294 which will engage the outer diameter of the tape feed wheel 200. The arcuate surface 294 extends approximately one hundred eighty degrees.

Located on the opposite sides of the arcuate surface 294 are inwardly-extending flanges 296 and 298. The width of the arcuate surface 294 is sufficient to accommodate the tape feed wheel 200, with the flanges 296 and 298 outlying the annular flanges 212 and 214 on the annular ridge 210 (best shown in FIGS. 11 and 12). Extending from the flange 296 near the end thereof closest to the cylindrical mounting segment 292 is a retaining pawl 300 which extends away from the cylindrical mounting segment 292. The retaining pawl 300 has one end thereof mounted on the flange 296, and extends at an angle approximately orthogonal to a radius of the arcuate surface 294, and is sufficiently thin to allow it to flex. Located on top of the arcuate surface 294 near the midpoint thereof is a flat retaining surface 302 which will be used to maintain the pawl cuff member 290 in its operating position (as will become evident in conjunction with a discussion of FIG. 27 below).

Figure 22:
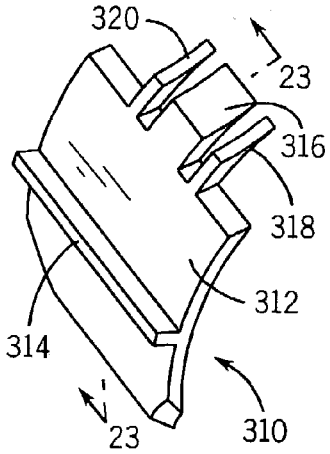
FIG. 22 is an isometric view of a scraping blade member from the left side and front thereof.
Figure 23:
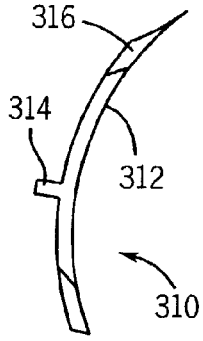
FIG. 23 is a side view of the scraping blade member illustrated in FIG. 22 from the left side thereof.

Moving now to FIGS. 22 and 23, a scraping blade member 310 is illustrated which will be used to remove any remaining segments of the indexed adhesive segment-laden carrier release tape 80 (shown in FIGS. 2 and 3) from the surface of the tape feed wheel 200 (best shown in FIG. 12). In the preferred embodiment, the scraping blade member 310 may be molded from plastic material. The scraping blade member 310 has a curved surface 312 having laterally extending rib 314 which extends across the curved surface 312. The rib 314 will be used to mount the retaining pawl 300 by placing the rib 314 intermediate the mounting posts 112 on the right housing member 100 (shown in FIG. 5).

Extending from the topmost edge of the curved surface 312 are three scrapping blades which are spaced slightly apart. A wider scraping blade 316 is located in the middle, and is flanked by two narrower scraping blades 318 and 320. The scraping blades 316, 318, and 320 will contact the cylindrical drive wheel 206 of the tape feed wheel 200 (best shown in FIG. 11). The wider scraping blade 316 will be located intermediate the annular ridges 208 and 210 of the tape feed wheel 200. The narrower scraping blade 318 will be located intermediate the annular ridges 208 and 212, and the narrower scraping blade 320 will be located intermediate the annular ridges 210 and 214.

Figure 24:
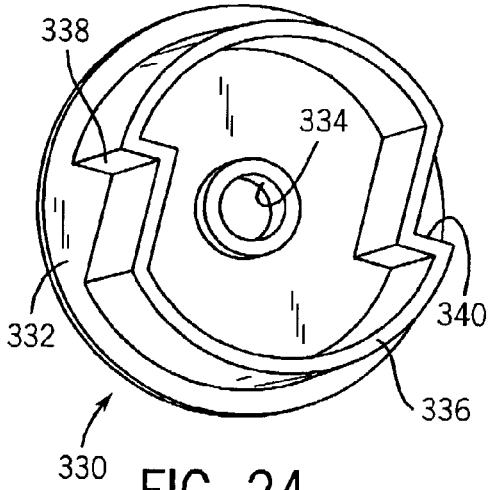
FIG. 24 is an isometric view of a supply spool.

Turning next to FIG. 24, a supply spool 330 upon which the core 90 of a tape roll 82 (shown in FIG. 2) will be placed is illustrated. In the preferred embodiment, the supply spool 330 may be molded from plastic material. The supply spool 330 has a circular backing plate 332 having an aperture 334 extending therethrough. Extending orthogonally from the backing plate 332 is a shaped form 336 having two recesses 338 and 340 located therein. The recesses 338 and 340 will accommodate the orientation facilitating segments 92 and 94 of the core 90 of the tape roll 82 therein to ensure that the tape roll 82 is mounted in the proper orientation on the supply spool 330. The core 90 of the tape roll 82 will fit onto the shaped form 336 in an interference fit to retain the tape roll 82 in place on the supply spool 330.

Figure 25:
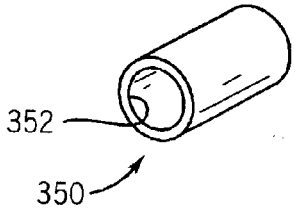
FIG. 25 is an isometric view of an adhesive segment collecting roller.

Moving now to FIG. 25, an adhesive segment collecting roller 350 is illustrated which will be mounted on the support post 124 of the right housing member 100 (best shown in FIG. 5). In the preferred embodiment, the adhesive segment collecting roller 350 may be molded from plastic material. The adhesive segment collecting roller 350 has an aperture 352 extending therethrough which will be used to mount the adhesive segment collecting roller 350 on the support post 124 of the right housing member 100. The adhesive segment collecting roller 350 will be used to pick up dispensable adhesive segments 84 (best shown in FIG. 3) which are not dispensed before the carrier release tape 80 moves into the feed mechanism.

Figure 26:
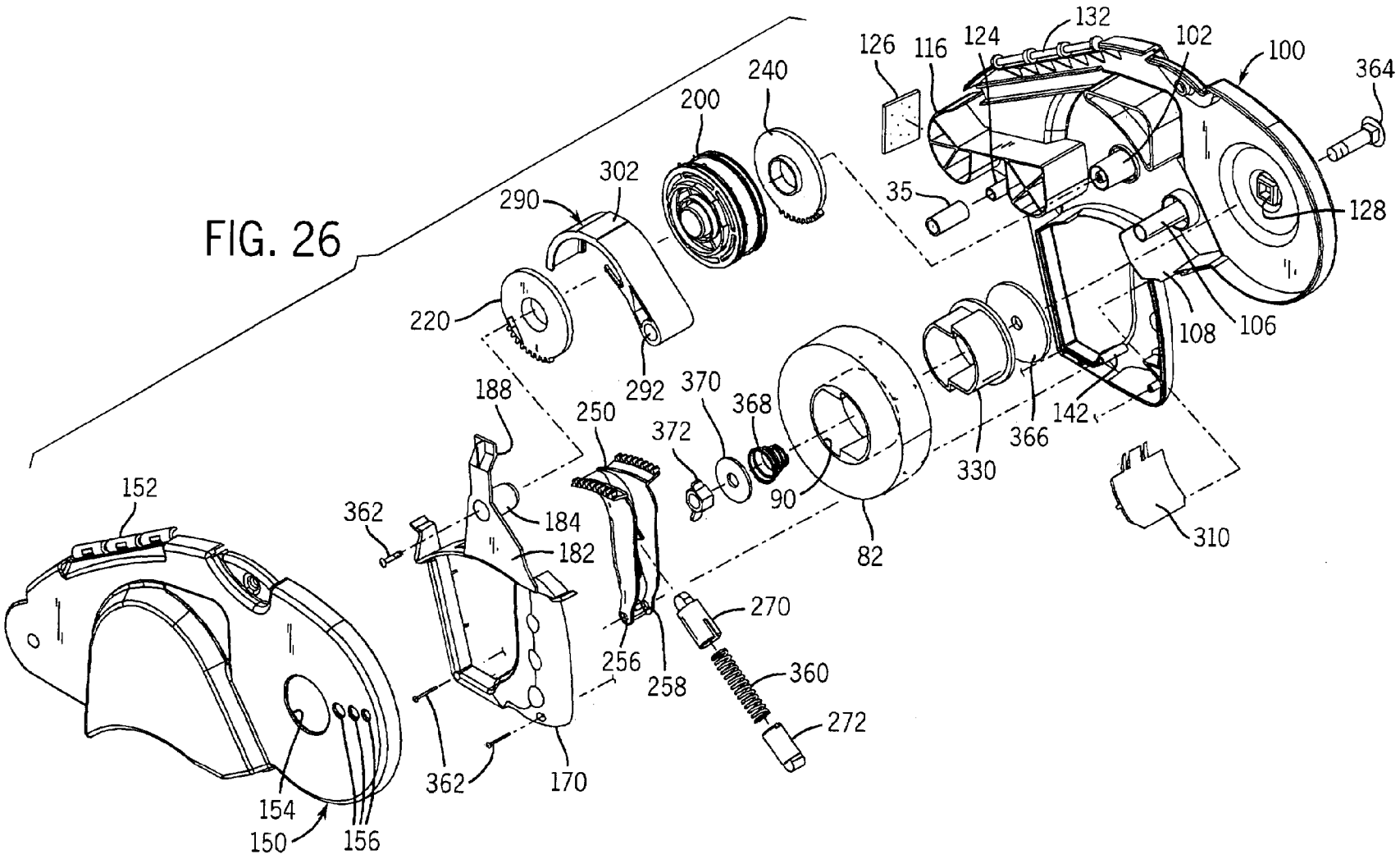
FIG. 26 is an exploded view showing the assembly of the various components shown in FIGS. 4 through 25 and other components to make the handheld mechanical adhesive segment applicator apparatus of the present invention.

Turning next to FIG. 26, the assembly of the various components illustrated in FIGS. 4 through 25 (and other miscellaneous components) is illustrated. The foam strip 126 is adhesively secured to the C-shaped tape guide surface 116 of the right housing member 100 (as it was shown in FIG. 5). The scraping blade member 310 is installed into the right housing member 100 with the rib 314 on the curved surface 312 (best shown in FIG. 22) being inserted between the mounting posts 112 on the right housing member 100 (shown in FIG. 5). In the preferred embodiment, the scraping blade member 310 is adhesively secured in place in the right housing member 100. The scraping blade member 310 and the tape guide 108 define a path therebetween through which the carrier release tape 80 will exit the handheld mechanical adhesive segment applicator apparatus. The adhesive segment collecting roller 350 is installed onto the support post 124 in the right housing member 100.

The geared spacer 240 is installed onto the right side of the tape feed wheel 200 (the side opposite the drive teeth 218), with the geared spacer 240 being mounted on the cylindrical hub 202. The cylindrical segment 244 on the geared spacer 240 (shown in FIG. 16) is oriented toward the tape feed wheel 200. The pawl gear 220 is installed onto the tape feed wheel 200 on the left side (the side with the drive teeth 218), with the pawl gear 220 being mounted on the cylindrical hub 202. The cylindrical segment 224 on the pawl gear 220 (best shown in FIG. 14) is oriented toward the tape feed wheel 200, and the drive pawl 228 will be in contact with the drive teeth 218 on the tape feed wheel 200. The tape feed wheel 200, with the pawl gear 220 and the geared spacer 240 attached, is then placed onto the mounting post 102 in the right housing member 100.

The pawl cuff member 290 is then installed by mounting it on the pivot post 106 in the right housing member 100 (the pivot post 106 extends through the cylindrical mounting segment 292 in the pawl cuff member 290). It will be appreciated by those skilled in the art that the pawl cuff member 290 can pivot such that the arcuate surface 294 of the pawl cuff member 290 (best shown in FIG. 21) in a first position is in close proximity to the outer diameter of the tape feed wheel 200, or in a second position is rotated away from the arcuate surface 294 to allow the carrier release tape 80 to initially be loaded around the tape feed wheel 200. The retaining pawl 300 on the cylindrical mounting segment 292 (best shown in FIG. 20) will be in contact with the drive teeth 218 on the tape feed wheel 200 when the pawl cuff member 290 is in the first position.

The trigger member 250 is mounted on the pivot post 142 in the right housing member 100 with the pivot post 142 extending through the aperture 258 and the aperture 256 in the trigger member 250. The teeth 266 of the trigger member 250 (best shown in FIG. 17) will be in contact with the teeth 246 of the geared spacer 240 (best shown in FIG. 16). The teeth 264 of the trigger member 250 (shown in FIG. 17) will be in contact with the teeth 226 of the pawl gear 220 (best shown in FIG. 14). It will be appreciated by those skilled in the art that the installation of the trigger member 250 into the right housing member 100 must be coordinated with the installation of the assembly consisting of the tape feed wheel 200, the pawl gear 220, and the geared spacer 240 in order to obtain and retain proper alignment of the teeth on the various components.

One end of a trigger spring 360 is inserted into the cylindrical housing 278 of the lower spring housing member 272 (shown in FIG. 19), and the other end of the trigger spring 360 is inserted into the cylindrical housing 274 of the upper spring housing member 270 (also shown in FIG. 19). The trigger spring 360 is compressed, and the projection 284 of the lower spring housing member 272 (also shown in FIG. 19) is inserted into the slot 282 of the upper spring housing member 270 (also shown in FIG. 19). The rounded bearing end 276 of the upper spring housing member 270 (also shown in FIG. 19) is placed against the bearing surface 268 of the trigger member 250 (best shown in FIG. 18). The rounded bearing end 280 of the lower spring housing member 272 is placed against the right bearing surface half 144 of the right housing member 100 (shown in FIG. 5). The assembly consisting of the upper spring housing member 270, the lower spring housing member 272, and the trigger spring 360 will bias the trigger member 250 in a counter-clockwise position, with the movement of the trigger member 250 being limited by the construction of the right housing member 100.

The handle housing member 170 is installed onto the right housing member 100, with the mounting post 184 extending into the cylindrical hub 202 of the tape feed wheel 200 (best shown in FIG. 12) to retain the assembly consisting of the tape feed wheel 200, the pawl gear 220, and the geared spacer 240 in place in the right housing member 100. The handle housing member 170 will also retain the trigger member 250 and the assembly consisting of the upper spring housing member 270, the lower spring housing member 272, and the trigger spring 360 in place.

Three screws 362 are used to retain the handle housing member 170 on the right housing member 100: a first screw 362 extending through the screw hole 186 in the handle housing member 170 (best shown in FIG. 8) and into the screw hole 104 in the mounting post 102 in the right housing member 100 (shown in FIG. 5); a second screw 362 extending through the screw hole 178 in the handle housing member 170 (best shown in FIG. 8) and into the screw hole 138 in the right housing member 100 (shown in FIG. 5); and a third screw 362 extending through the screw hole 180 in the handle housing member 170 (best shown in FIG. 8) and into the screw hole 140 in the right housing member 100 (shown in FIG. 5).

Figure 27:
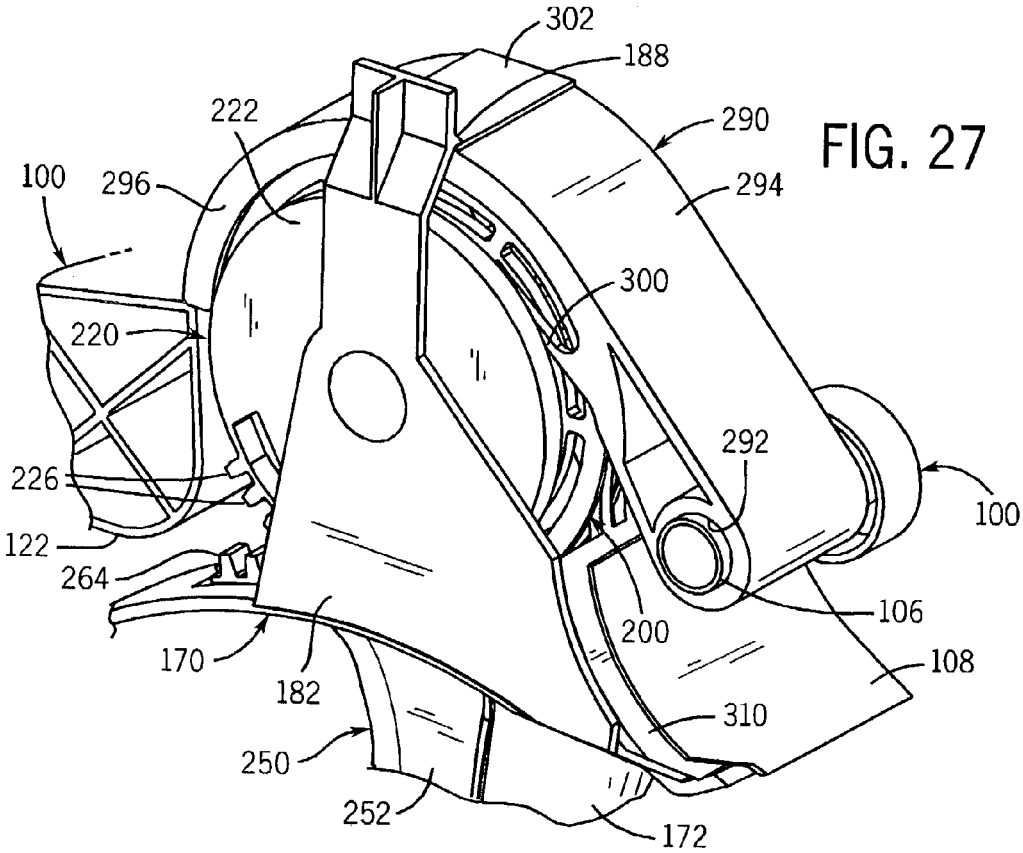
FIG. 27 is a partial isometric view of the assembled handheld mechanical adhesive segment applicator apparatus of FIG. 26, showing the retention of the pawl cuff member by the handle housing member.

Referring for the moment to FIG. 27 in addition to FIG. 26, the retaining latch 188 on the handle housing member 170 will also contact the flat retaining surface 302 on the pawl cuff member 290 when the pawl cuff member 290 is in the first position close adjacent the tape feed wheel 200, thereby retaining the pawl cuff member 290 in its first position. By lifting the retaining latch 188 slightly, the pawl cuff member 290 is freed to allow it to rotate to its second position away from the tape feed wheel 200.

Referring again to FIG. 26, a carriage bolt 364 is inserted from the outside of the right housing member 100 through the square aperture 128 in the right housing member 100. A reinforced rubber washer 366 is placed onto the carriage bolt 364, following which the supply spool 330 is mounted onto the carriage bolt 364 (with the carriage bolt 364 extending through the aperture 334 in the supply spool 330 (shown in FIG. 24)). The reinforced rubber washer 366 provides a modicum of frictional resistance preventing the supply spool 330 from spinning freely, but allowing it to rotate. A conical spool spring 368 is then placed on the carriage bolt 364, followed by a washer 370 and a wingnut 372. The wingnut 372 can be used to adjust the rotational resistance of the supply spool 330.

The housing door member 150 is mounted onto the right housing member 100 by attaching the left hinge half 152 on the housing door member 150 to the right hinge half 132 on the right housing member 100. It will be appreciated that the housing door member 150 will open on the right housing member 100 by swinging upwardly. The latching member 160 on the bottom of the housing door member 150 (best shown in FIG. 7) cooperates with the latching member 146 on the right housing member 100 (shown in FIGS. 4 and 5) to releasably secure the housing door member 150 on the right housing member 100.

A tape roll 82 can be installed on the supply spool 330, with the orientation facilitating segments 92 and 94 on the core 90 (shown in FIG. 2) cooperating with the recesses 338 and 340 on the supply spool 330 (shown in FIG. 24) to ensure that the tape roll 82 can only be installed in the proper orientation. When the tape roll 82 is installed in the handheld mechanical adhesive segment applicator apparatus, the wingnut 372 can be adjusted through the large aperture 154 in the housing door member 150, thereby allowing the tension on the tape roll 82 to be adjusted without opening the housing door member 150. The apertures 156 in the housing door member 150 allow a user to see how much of the tape roll 82 remains.

Figure 28:
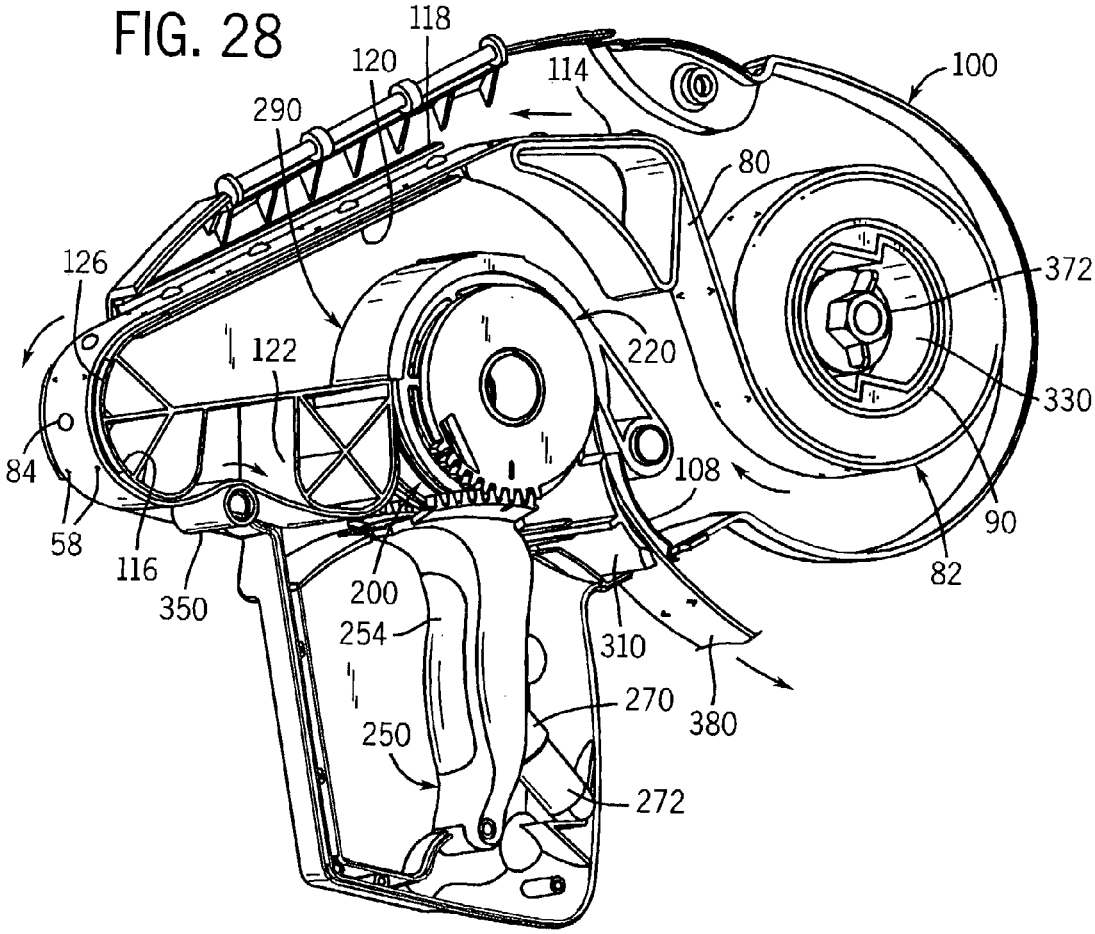
FIG. 28 is an isometric view of the handheld mechanical adhesive segment applicator apparatus with indexed adhesive segment-laden carrier release tape extending therethrough, and with the housing door member removed for clarity.

Referring next to FIG. 28, the installation of a tape roll 82 in the handheld mechanical adhesive segment applicator apparatus is illustrated. The core 90 of the tape roll 82 is installed onto the supply spool 330, and the wingnut 372 is adjusted as necessary to adjust the tension in the tape roll 82 as the indexed adhesive segment-laden carrier release tape 80 is unrolled off of the core 90. The indexed adhesive segment-laden carrier release tape 80 passes over the tape guide surface 114 of the right housing member 100, between the guide members 118 and 120 of the right housing member 100, and onto the C-shaped tape guide surface 116. Much of the C-shaped tape guide surface 116 is covered with the foam strip 126, and the indexed adhesive segment-laden carrier release tape 80 moves over the foam strip 126 on the C-shaped tape guide surface 116.

The dispensable adhesive segments 84 are dispensed from the forwardmost portion of the C-shaped tape guide surface 116, with the foam strip 126 facilitating the dispensing of the dispensable adhesive segments 84. Following removal of the dispensable adhesive segments 84 from the indexed adhesive segment-laden carrier release tape 80, it will be referred to herein as spent carrier release tape 380. The spent carrier release tape 380 moves over the adhesive segment collecting roller 350, and under the U-shaped tape guide surface 122. If any dispensable adhesive segments 84 remain on the spent carrier release tape 380, they will be collected by the adhesive segment collecting roller 350, which has a higher adhesion to the dispensable adhesive segments 84 than does the spent carrier release tape 380.

The spent carrier release tape 380 moves up the back side of the U-shaped tape guide surface 122 and onto the tape feed wheel 200, where the teeth 216 of the tape feed wheel 200 (best shown in FIGS. 11 and 12) fit into the indexing notches 58 in the spent carrier release tape 380. The pawl cuff member 290 retains the spent carrier release tape 380 in contact with the tape feed wheel 200 (and thus retains the indexing notches 58 on the spent carrier release tape 380 in contact with the teeth 216 of the tape feed wheel 200). The spent carrier release tape 380 leaves the tape feed wheel 200 on the rearmost side and leaves the handheld mechanical adhesive segment applicator apparatus by moving between the tape guide 108 and the scraping blade member 310.

Figure 29:
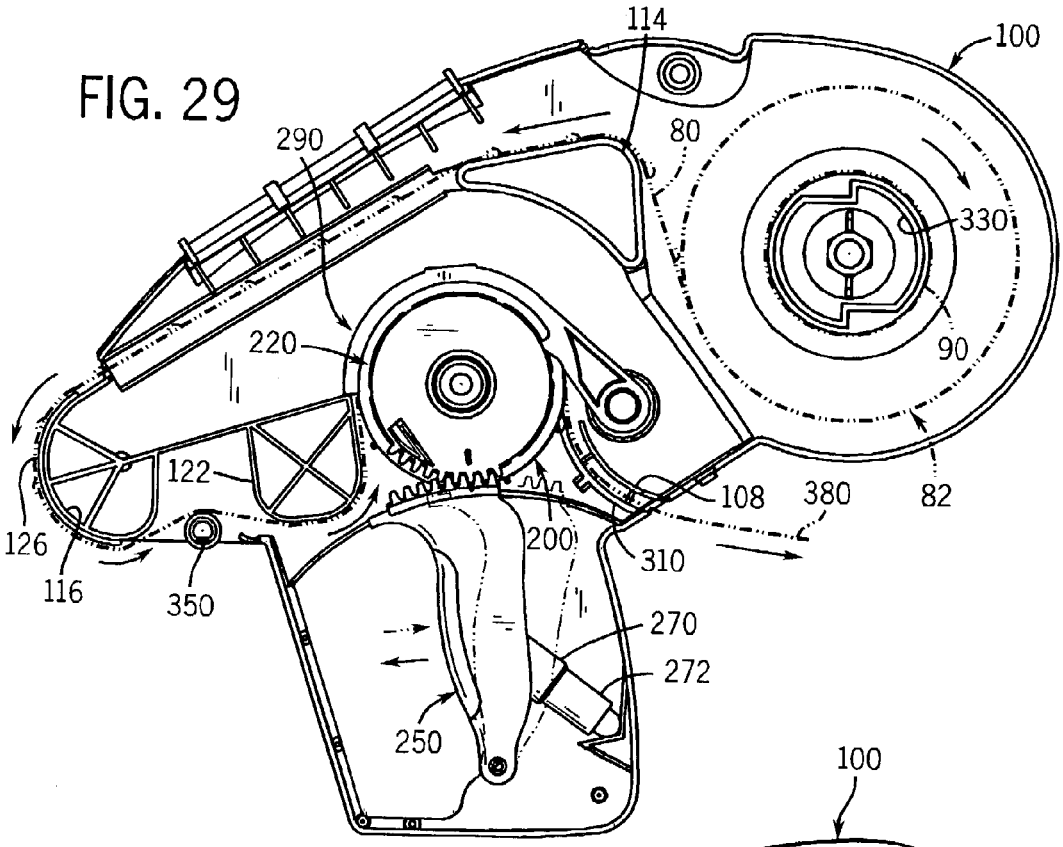
FIG. 29 is a plan view of the handheld mechanical adhesive segment applicator apparatus, with movement of the trigger member causing movement of the indexed adhesive segment-laden carrier release tape extending therethrough, and with the housing door member and the handle housing member removed for clarity.

Referring now to FIG. 29, this movement of the indexed adhesive segment-laden carrier release tape 80 to the point of dispensation of the dispensable adhesive segments 84 and the movement of the spent carrier release tape 380 from that point through the feed mechanism and out of the handheld mechanical adhesive segment applicator apparatus is schematically shown. Actuation of the trigger member 250 causes the advancement of the indexed adhesive segment-laden carrier release tape 80 and the spent carrier release tape 380 through the handheld mechanical adhesive segment applicator apparatus. Each advancement will move another dispensable adhesive segment 84 to the point on the C-shaped tape guide surface 116 from which it may be dispensed.

Figure 30:
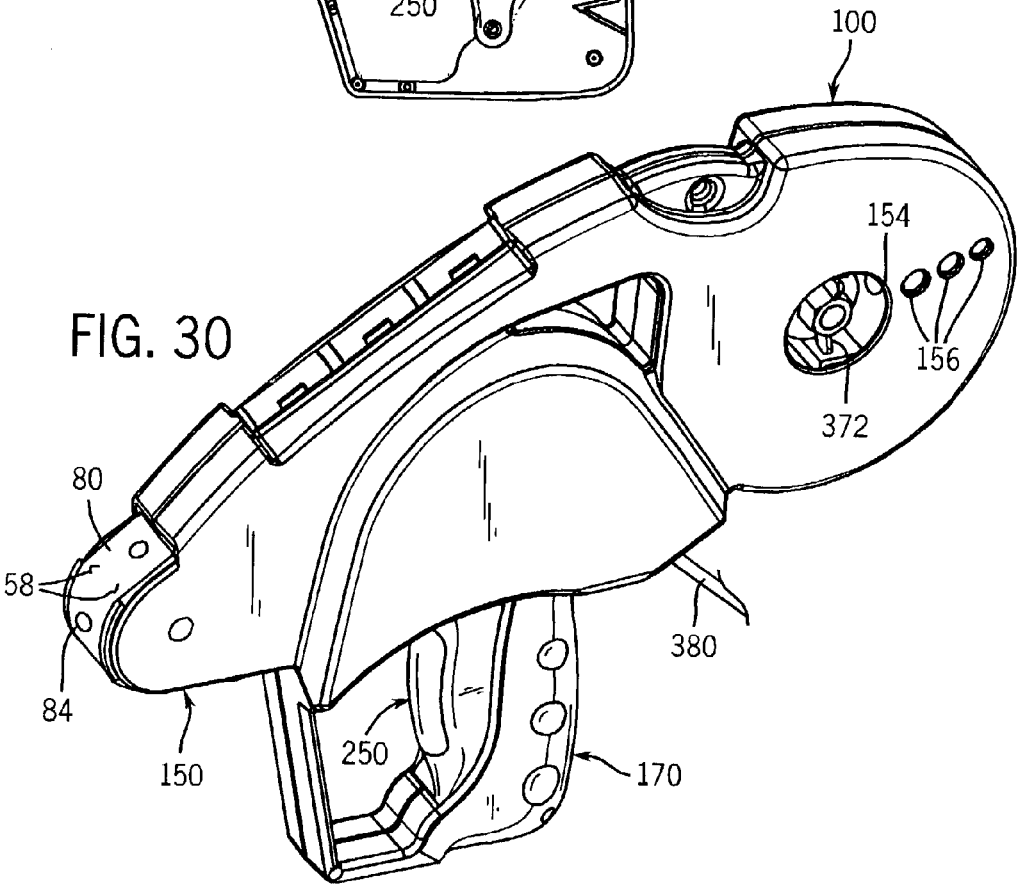
FIG. 30 is an isometric view of the fully assembled handheld mechanical adhesive segment applicator apparatus.

FIG. 30 shows the assembled handheld mechanical adhesive segment applicator apparatus with the housing door member 150 in place. Also note that the aperture 158 in the housing door member 150 (shown in FIGS. 6 and 7) is aligned with the aperture 130 (shown in FIGS. 4 and 5). The aligned apertures 130 and 158 can be used to hang the handheld mechanical adhesive segment applicator apparatus from a hook or the like (not shown) for storage purposes, or to allow the weight of the device to be supported by a tool balancer.

Figure 31:
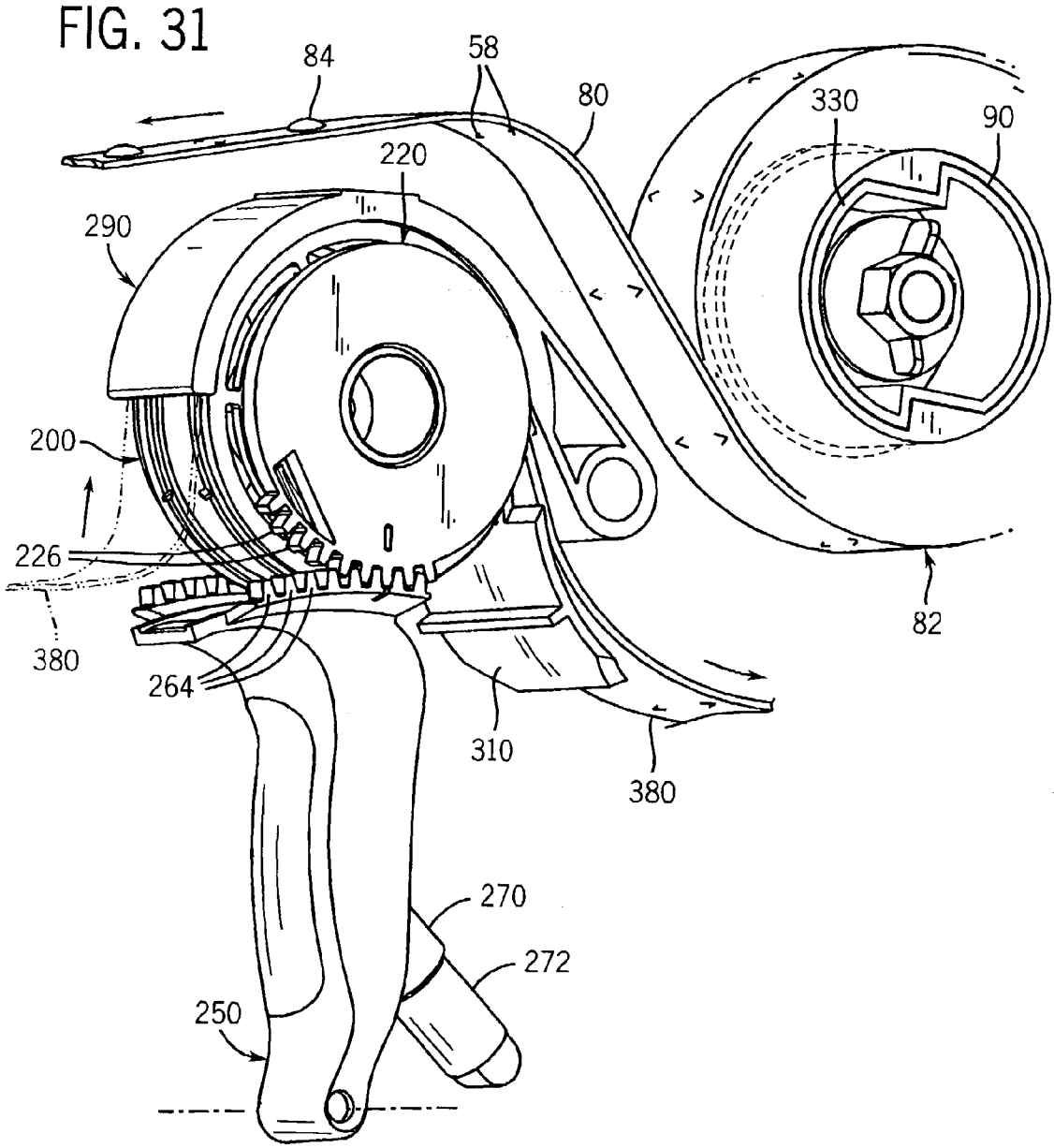
FIG. 31 is a schematic depiction of the feed mechanism of the handheld mechanical adhesive segment applicator apparatus from the left side and the front.

Referring next to FIG. 31, the feed mechanism is shown in isolation. It will be appreciated that by squeezing the trigger member 250, the indexed adhesive segment-laden carrier release tape 80 will be drawn off of the core 90. After the dispensing of the dispensable adhesive segments 84, the spent carrier release tape 380 will be drawn into the feed mechanism, onto the tape feed wheel 200 and under the pawl cuff member 290. The scraping blade member 310 will pull the spent carrier release tape 380 off of the tape feed wheel 200, with the spent carrier release tape 380 then being removed from the handheld mechanical adhesive segment applicator apparatus.

Figure 32:
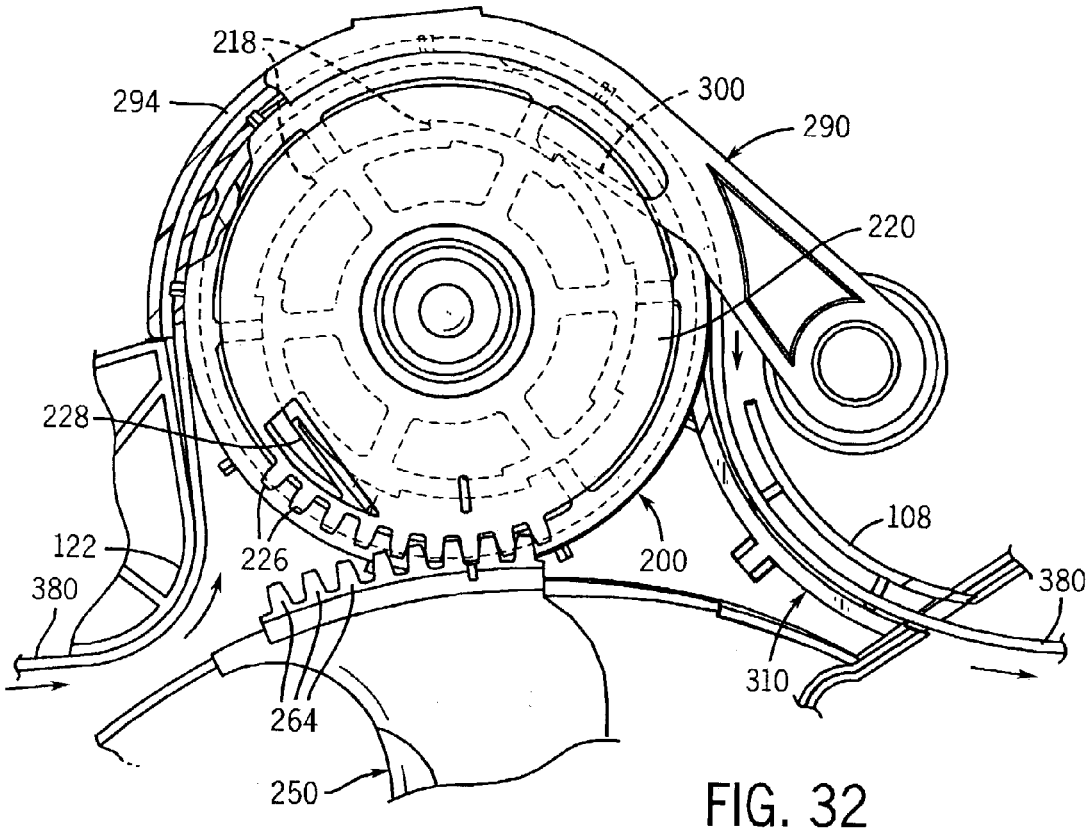
FIG. 32 is a partial view from the left side of the feed mechanism of the handheld mechanical adhesive segment applicator apparatus in a resting position.

Referring now to FIG. 32, the operation of the feed mechanism is illustrated. It will be appreciated that by squeezing the trigger member 250, it will rotate clockwise (when viewed from the left side as in FIG. 32), moving from a first (unsqueezed) position to a second (squeezed) position to cause the pawl gear 220 to rotate counterclockwise (when viewed from the left side as in FIG. 31). Similarly, when the trigger spring 360 (shown in FIG. 26) causes the trigger member 250 to rotate counterclockwise (again when viewed from the left side), returning from the second position to the first position, it will cause the tape feed wheel 200 to rotate clockwise (again when viewed from the left side).

The functions of the pawl 228 (on the pawl gear 220) and the pawl 300 (on the pawl cuff member 290) are readily apparent as they both interact with the drive teeth 218 on the tape feed wheel 200 as it rotates. The retaining pawl 300 acts to prevent rotation of the tape feed wheel 200 in a counterclockwise direction (again when viewed from the left side). The drive pawl 228 acts to rotate the tape feed wheel 200 in a clockwise direction.

Thus, when the trigger member 250 moves from the first position to the second position, it cannot cause the pawl gear 220 to move counterclockwise (again as viewed from the left side), since the retaining pawl 300 is in contact with a tooth 218 and will not permit counterclockwise rotation of the tape feed wheel 200 (again as viewed from the left side) Instead, the drive pawl 228 will move from one drive tooth 218 on the tape feed wheel 200 to the next drive tooth 218.

However, as the trigger member 250 returns from its second position to its first position, the drive pawl 228 will cause the tape feed wheel 200 to rotate in a clockwise direction (again as viewed from the left side). As the tape feed wheel 200 turns clockwise (again as viewed from the left side), the retaining pawl 300 will allow it to do so, with the retaining pawl 300 slipping from one tooth 218 to the next tooth 218.

Each time the trigger member 250 is squeezed and then released, the tape feed wheel 200 will be advanced by one tooth 218. This pulls the indexed adhesive segment-laden carrier release tape 80 (best shown in FIG. 28) to advance the next consecutive dispensable adhesive segment 84 on the indexed adhesive segment-laden carrier release tape 80 to the point on the C-shaped tape guide surface 116 of the right housing member 100 (also best shown in FIG. 28) from which it will be dispensed.

Figure 33:
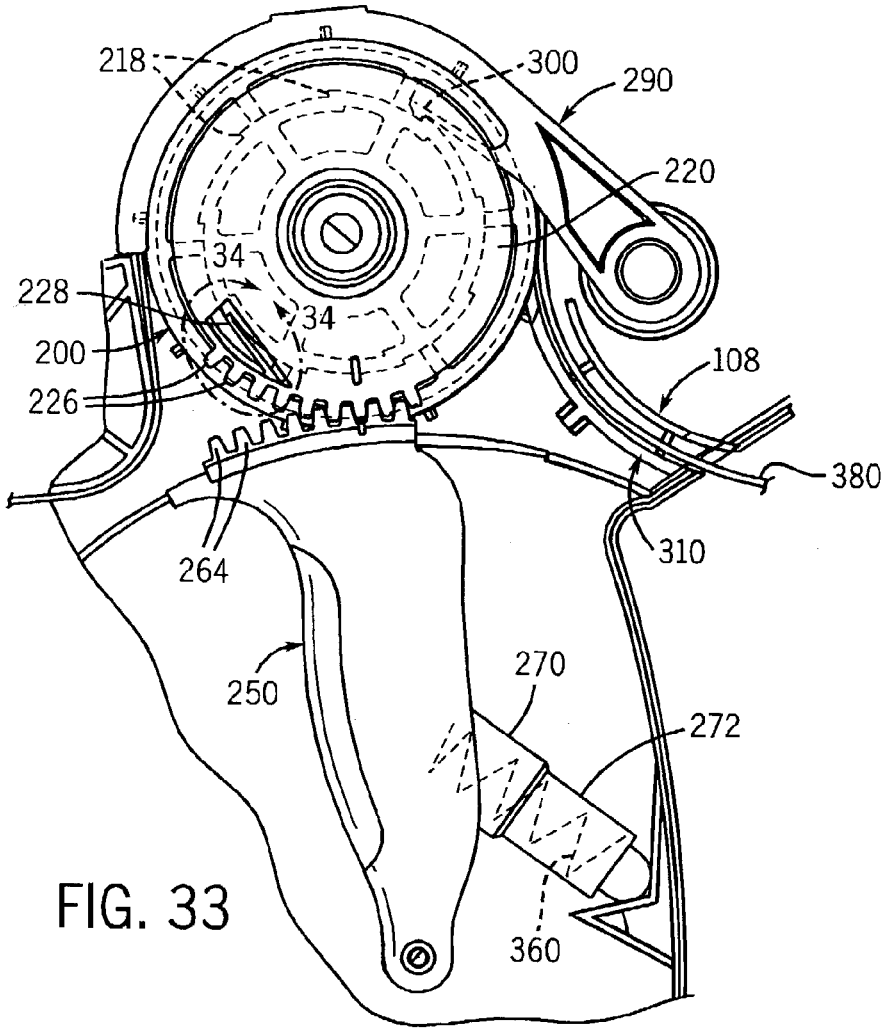
FIG. 33 is a partial view from the left side of the feed mechanism illustrated in FIG. 32 in the resting position, showing the relative positions of the trigger member, the pawl gear, the pawls on the pawl gear and the pawl cuff member, and the teeth of the tape feed wheel ratchet gear.
Figure 34:
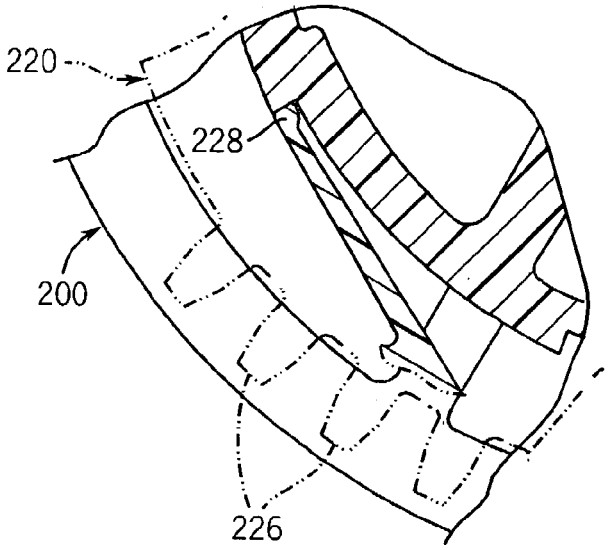
FIG. 34 is an enlarged, fragmentary view of the feed mechanism in the resting position illustrated in FIG. 33, showing the pawl gear and its pawl and the teeth of the tape feed wheel ratchet gear.

This operation of the feed mechanism is shown in detail in FIGS. 33 through 38. Referring first to FIGS. 33 and 34, the trigger member 250 is in its first position, prior to being actuated. The retaining pawl 300 on the pawl cuff member 290 contacts a drive tooth 218 to prevent the tape feed wheel 200 from moving counterclockwise (again, when viewed from the left side). The drive pawl 228 on the pawl gear 220 is adjacent another tooth 218, but the pawl gear 220 can freely move in a counterclockwise direction as the trigger member 250 is actuated to move it to its second position.

Figure 35:
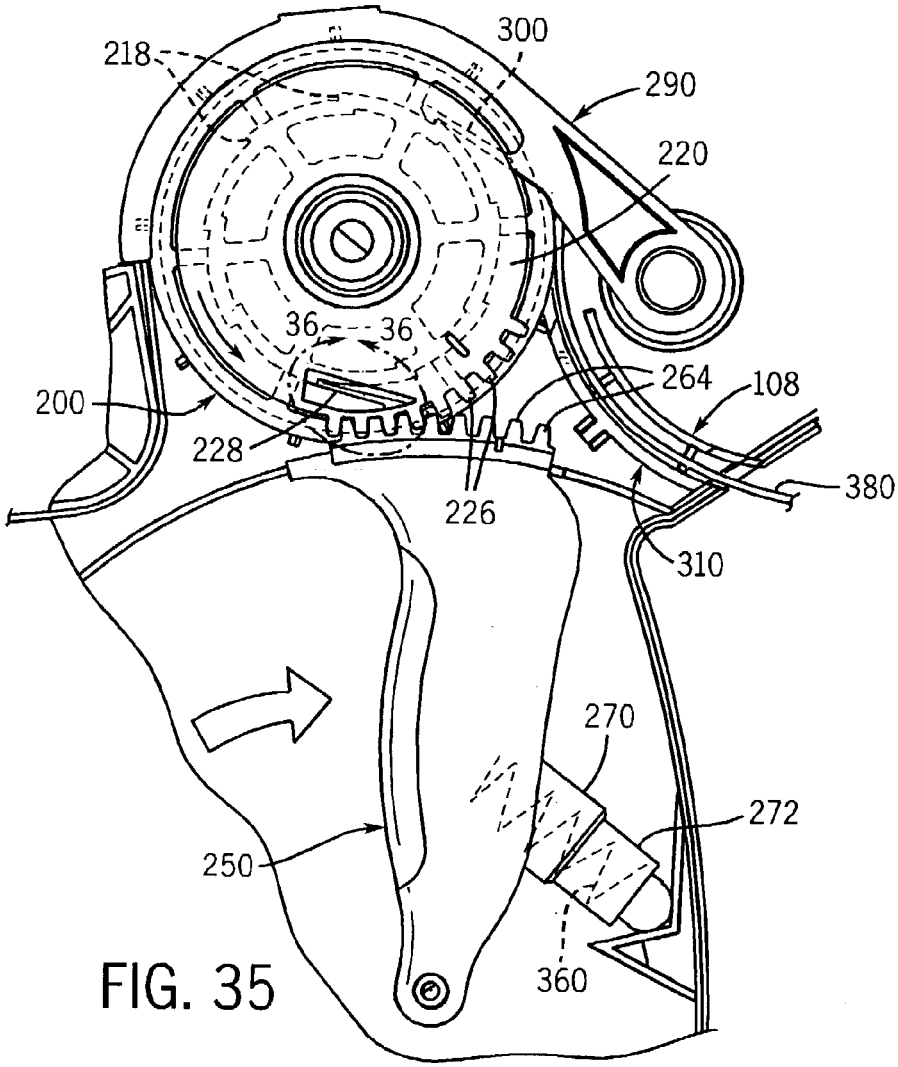
FIG. 35 is a partial view from the left side of the feed mechanism illustrated in FIG. 33 in a compressed position, showing the relative positions of the trigger member, the pawl gear, the pawls on the pawl gear and the pawl cuff member, and the teeth of the tape feed wheel ratchet gear.
Figure 36:
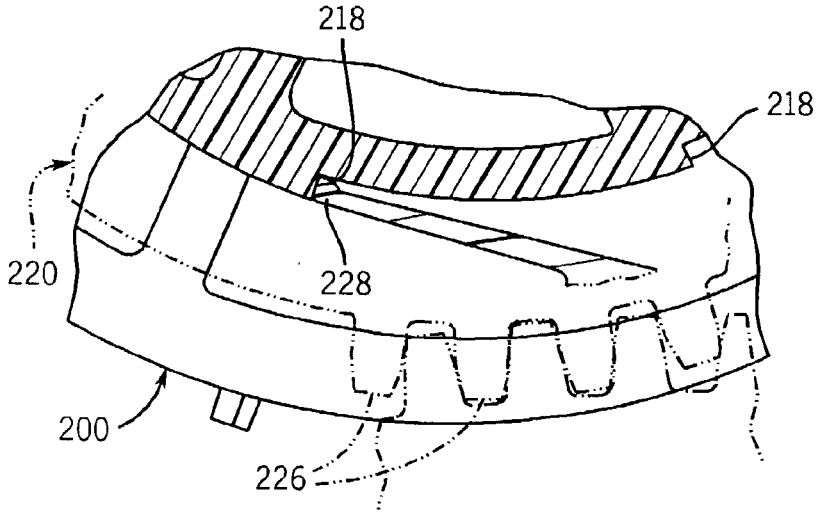
FIG. 36 is an enlarged, fragmentary view of the feed mechanism in the compressed position illustrated in FIG. 35, showing the pawl gear and its pawl and the teeth of the tape feed wheel ratchet gear.

Referring next to FIGS. 35 and 36, the trigger member 250 has been actuated to move it to its second position. The pawl gear 220 has moved to its fully counterclockwise position (again, when viewed from the left side), and the tape feed wheel 200 has been prevented from moving by the retaining pawl 300 on the pawl cuff member 290. The drive pawl 228 on the pawl gear 220 has moved to the next tooth 218, and has dropped down in front of it. It will thereby be appreciated by those skilled in the art that when the trigger member 250 is released, the trigger spring 360 will cause it to return to its first position, and the drive pawl 228 will drive the tape feed wheel 200 to rotate in a clockwise direction (again, when viewed from the left side).

Figure 37:
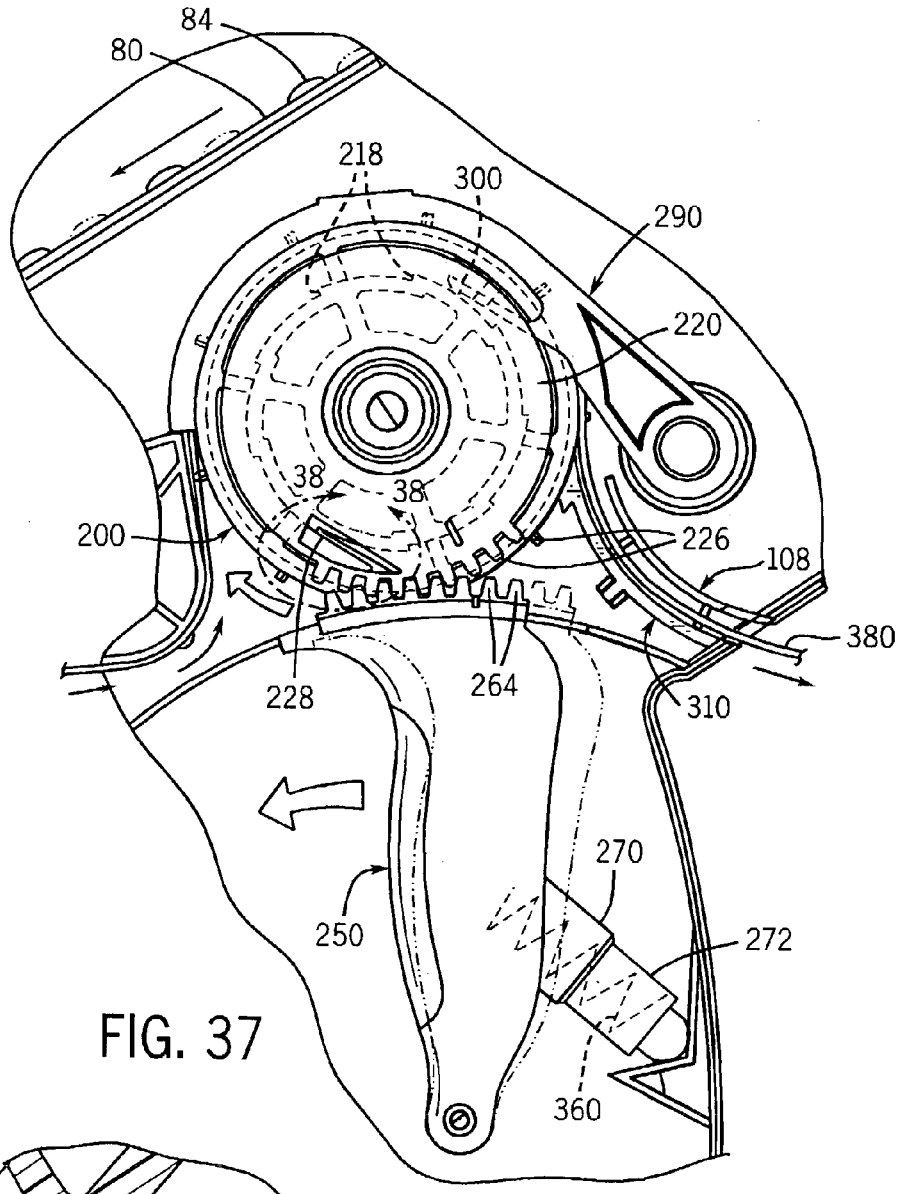
FIG. 37 is a partial view from the left side of the feed mechanism illustrated in FIGS. 33 and 35 in a released position, showing the relative positions of the trigger member, the pawl gear, the pawls on the pawl gear and the pawl cuff member, and the teeth of the tape feed wheel ratchet gear.
Figure 38:
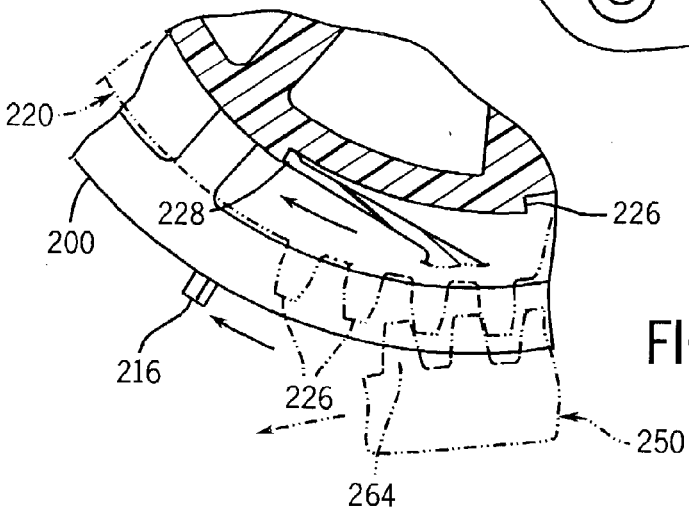
FIG. 38 is an enlarged, fragmentary view of the feed mechanism in the released position illustrated in FIG. 35, showing the pawl gear and its pawl and the teeth of the tape feed wheel ratchet gear.

Moving now to FIGS. 37 and 38, the trigger member 250 is shown midway in its movement from its second position to its first position. It may be seen that the drive pawl 228 of the pawl gear 220, which bears against a tooth 218 on the tape feed wheel 200, has moved the tape feed wheel 200 in a clockwise direction. It will be noted that the retaining pawl 300 of the pawl cuff member 290 does not restrict movement in the clockwise direction. When the trigger member 250 has moved fully back to its first position, the tape feed wheel 200 will have been turned further in a clockwise direction, moving the next tooth 218 past the retaining pawl 300, with the retaining pawl 300 dropping down over that tooth 218.

Figure 39:
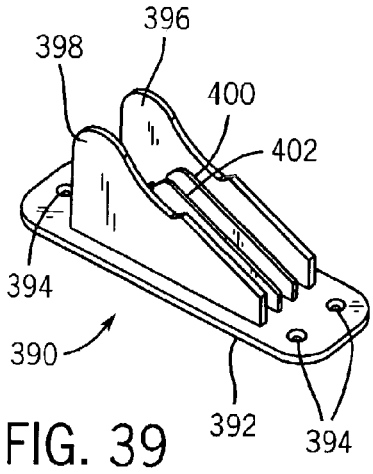
FIG. 39 is an isometric view of a docking station which acts as a stand for the handheld mechanical adhesive segment applicator apparatus.
Figure 40:
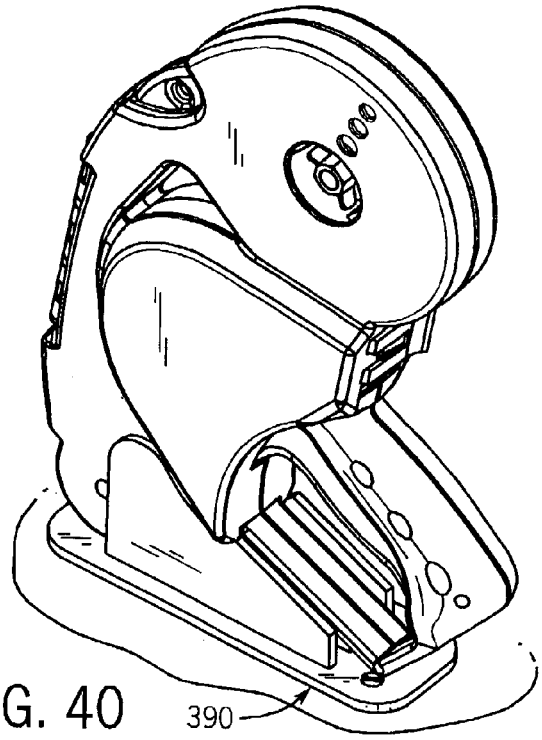
FIG. 40 is an isometric view of the handheld mechanical adhesive segment applicator apparatus resting in the docking station illustrated in FIG. 39.

Turning next to FIG. 39, a stand 390 for the handheld mechanical adhesive segment applicator apparatus is illustrated. The stand 390 has a base member 392 having a plurality of apertures 392 therein which may be used to mount the stand 390 onto a surface (not shown). The stand 390 has two lateral support members 394 and 396 which extend orthogonally from the apertures 392 in a spaced-apart relationship. The lateral support members 394 and 396 are as wide as the width of the handheld mechanical adhesive segment applicator apparatus at its forward portion (the forward portions of the right housing member 100 (best shown in FIG. 4) and the housing door member 150 (best shown in FIG. 6)), and will engage this forward portion of the handheld mechanical adhesive segment applicator apparatus as well as the sides of the right trigger guard half 136 of the right housing member 100 (also best shown in FIG. 4) and the left trigger guard half 174 of the housing door member 150 (also best shown in FIG. 6). Located intermediate the lateral support members 394 and 396 are two handle support members 398 and 400, which are also spaced apart. The handle support members 398 and 400 will support the front sides of the right housing member 100 and the left trigger guard half 174 of the housing door member 150. Referring finally to FIG. 40, the handheld mechanical adhesive segment applicator apparatus is shown stored in the stand 390.

It may therefore be seen that the present invention teaches a handheld mechanical adhesive segment applicator apparatus capable of dispensing adhesive segments from an adhesive segment-laden carrier release tape. The handheld mechanical adhesive segment applicator apparatus has a drive mechanism for engaging an indexing instrumentality on the adhesive segment-laden carrier release tape to allow it to dispense adhesive segments. The handheld mechanical adhesive segment applicator apparatus is adaptable to apply adhesive segments to non-flat, recessed, difficult to reach, or unstable surfaces in a simple, efficient, safe, and automatic manner.

The handheld mechanical adhesive segment applicator apparatus of the present invention is of construction which is both durable and long lasting, and which requires little or no maintenance to be provided by the user throughout its operating lifetime. The handheld mechanical adhesive segment applicator apparatus of the present invention is also of inexpensive construction to enhance its market appeal and to thereby afford it the broadest possible market. Finally, all of the aforesaid advantages and objectives of the handheld mechanical adhesive segment applicator apparatus of the present invention are achieved without incurring any substantial relative disadvantage.

What is claimed is:

1. An apparatus for applying adhesive segments which are dispensed from an extended length of indexed carrier release tape, said apparatus comprising:

a housing adapted to receive the indexed carrier release tape bearing adhesive segments, said housing including an adhesive segment application surface from which an adhesive segment on a portion of the indexed adhesive segment bearing carrier release tape which is located on said adhesive segment application surface may be applied;

an advancement mechanism mounted in said housing which engages indices on the indexed carrier release tape to advance the indexed carrier release tape on said adhesive segment application surface; and an actuator operatively connected to said advancement mechanism to cause said advancement mechanism to incrementally advance the indexed carrier release tape to bring the next consecutive adhesive segment on the indexed carrier release tape to said adhesive segment application surface for application therefrom upon each consecutive activation of said actuator;

wherein said advancement mechanism comprises a feed wheel rotatably mounted in said housing, said feed wheel having a plurality of index-engaging elements mounted upon an outer cylindrical surface thereof, the carrier release tape extending around a portion of said feed wheel and said index-engaging elements on said feed wheel engaging indices on the carrier release tape to thereby advance the carrier release tape as said feed wheel rotates; and wherein said feed wheel includes an annular groove centrally located in the outer cylindrical surface thereof, and wherein said annular groove is sufficiently deep to allow any adhesive segments on the side of the carrier release tape facing said outer cylindrical surface of said feed wheel to be accommodated therein without contacting said feed wheel.

2. An apparatus as defined in claim 1, wherein said housing comprises:

a main housing member upon which said adhesive segment application surface is mounted and from which said adhesive segment application surface extends, said advancement mechanism and said actuator also being mounted in main housing member, said main housing member having an opening therein; and a housing door for enclosing said opening in said main housing member.

3. An apparatus as defined in claim 2, wherein said housing door is hingedly mounted on said main housing member to selectively provide access to the interior of said main housing member.

4. An apparatus as defined in claim 2, wherein said extended length of indexed adhesive segment bearing carrier release tape is wound onto a roll, and wherein said main housing member includes an area for storing the roll of adhesive segment bearing carrier release tape therein.

5. An apparatus as defined in claim 4, additionally comprising:

a spool rotatably mounted in said main housing member, the roll of adhesive segment bearing carrier release tape being installed on said spool.

6. An apparatus as defined in claim 5, additionally comprising:

a tension adjustment mechanism to adjust the tension on said spool as indexed adhesive segment bearing carrier release tape on a roll on said spool is advanced by said advancement mechanism.

7. An apparatus as defined in claim 1, wherein said housing is generally gun-shaped, said housing having a handle which may be gripped by a user, and wherein said actuator is mounted in said housing as a trigger.

8. An apparatus as defined in claim 1, additionally comprising:

a first guide member mounted in said housing for guiding the carrier release tape from a source onto said adhesive segment application surface;

a second guide member mounted in said housing for guiding the carrier release tape from said adhesive segment application surface to said advancement mechanism; and a third guide member mounted in said housing for guiding the carrier release tape from said advancement mechanism out of said housing.

9. An apparatus as defined in claim 1, wherein said adhesive segment application surface as arranged and configured to flex a portion of the indexed adhesive segment bearing carrier release tape which is located thereupon to expose a single adhesive segment for application to a work surface.

10. An apparatus as defined in claim 9, wherein said adhesive segment application surface comprises:

an application surface made of a relatively hard material; and a segment of resilient material to facilitate the application of adhesive segments from said adhesive segment application surface to a work surface.

11. An apparatus as defined in claim 10, wherein said segment of resilient material is made of a resilient foam material.

12. An apparatus as defined in claim 10, wherein said segment of resilient material is between approximately between one-sixteenth of an inch thick and one-half of an inch thick.

13. An apparatus as defined in claim 10, additionally comprising:

a nonstick surface located on said segment of resilient material to facilitate movement of carrier release tape as it is advanced thereupon.

14. An apparatus as defined in claim 13, wherein said nonstick surface comprises:

a thin strip of tape made from a durable material having a very low coefficient of friction.

15. An apparatus as defined in claim 1, additionally comprising:

a stripping mechanism located in the path of the carrier release tape after the carrier release tape has been advanced over said adhesive segment application surface to remove adhesive segments from carrier tape to prevent the adhesive segments from reaching said advancement mechanism.

16. An apparatus as defined in claim 15, wherein said stripping mechanism comprises:

a cylindrical roller which is rotatably mounted in said housing, the carrier release tape extending over said cylindrical roller with the side of the carrier release tape upon which the adhesive segments are located facing said cylindrical roller, the adhesive segments thereby being pulled off of the carrier release tape as it passes over said cylindrical roller.

17. An apparatus as defined in claim 16, wherein said cylindrical roller is mounted in said housing so as to be accessible from outside said housing to allow a user to remove adhesive segments collected on said cylindrical roller.

18. An apparatus as defined in claim 1, wherein said index-engaging elements on said feed wheel are uniformly spaced about said outer cylindrical surface of said feed wheel, the spacing between rotationally adjacent ones of said index-engaging elements being identical to the distance between longitudinally adjacent ones of the indices on the carrier release tape.

19. An apparatus as defined in claim 1, wherein said advancement mechanism additionally comprises:

a cuff member which is pivotally mounted in said housing and moveable between a first position in which said cuff member is spaced away from said outer cylindrical surface of said feed wheel to allow the carrier release tape to be installed onto said feed wheel, and a second position in which said cuff member closely engages a portion of said outer cylindrical surface of said feed wheel to maintain the carrier release tape on said feed wheel; and a retaining member for releasably retaining said cuff member in said second position.

20. An apparatus as defined in claim 19, wherein said advancement mechanism additionally comprises:

a unidirectional mechanism which allows said feed wheel to rotate in only one direction.

21. An apparatus as defined in claim 20, wherein said unidirectional mechanism comprises:

a plurality of radially outwardly extending teeth located on said feed wheel in a circular array; and a pawl which is in engagement with said plurality of radially outwardly extending teeth on said feed wheel, wherein said pawl is mounted on and extends from said cuff member.

22. An apparatus as defined in claim 1, wherein said actuator comprises:

a trigger member which is pivotally mounted in said housing and moveable between first non-actuated position and a second actuated position; and a drive member which is moved between first and second positions by the respective movement of said trigger member between its first and second positions, movement of said drive member in one direction causing said feed wheel to rotate to advance the carrier release tape, movement of said drive member in the other direction not causing said feed wheel to rotate.

23. An apparatus as defined in claim 22, wherein movement of said drive member from its second position to its first position causes said feed wheel to rotate.

24. An apparatus as defined in claim 22, wherein said feed wheel has a plurality of radially outwardly extending teeth located on in a circular array thereupon, and wherein said drive member rotates coaxially with said feed wheel, said drive member comprising:

a pawl which is in engagement with said plurality of radially outwardly extending teeth on said feed wheel.

25. An apparatus as defined in claim 22, additionally comprising:

a biasing element for biasing said trigger member from said second position to said first position.

26. An apparatus as defined in claim 25, wherein said biasing element comprises:

a spring.

27. An apparatus as defined in claim 1, additionally comprising:

an element mounted in said housing for removing the carrier release tape from engagement with said feed wheel and directing the spent carrier release tape out of said apparatus.

28. An apparatus as defined in claim 27, additionally comprising:

a guide member mounted in said housing which is spaced away from said removing element and which facilitates the direction of spent carrier release tape out of said apparatus.

29. An apparatus as defined in claim 1, additionally comprising:

an attachment mechanism to facilitate the mounting of said apparatus on a tool balancer to bear the weight of said apparatus.

30. An apparatus as defined in claim 1, additionally comprising:

a stand member for supporting said apparatus thereupon in a manner whereby an adhesive segment located on a portion of the indexed adhesive segment bearing carrier release tape which is located on said adhesive segment application surface will be supported away from contact with either said stand member or a surface upon which said stand member is mounted.

31. An apparatus for applying adhesive segments which are dispensed from an extended length of indexed carrier release tape, said apparatus comprising:

a housing adapted to receive the indexed carrier release tape bearing adhesive segments, said housing including an adhesive segment application surface from which an adhesive segment on a portion of the indexed adhesive segment bearing carrier release tape which is located on said adhesive segment application surface may be applied;

an advancement mechanism mounted in said housing which engages indices on the indexed carrier release tape to advance the indexed carrier release tape on said adhesive segment application surface; and an actuator operatively connected to said advancement mechanism to cause said advancement mechanism to incrementally advance the indexed carrier release tape to bring the next consecutive adhesive segment on the indexed carrier release tape to said adhesive segment application surface for application therefrom upon each consecutive activation of said actuator;

wherein said advancement mechanism comprises a feed wheel rotatably mounted in said housing, said feed wheel having a plurality of index-engaging elements mounted upon an outer cylindrical surface thereof, the carrier release tape extending around a portion of said feed wheel and said index-engaging elements on said feed wheel engaging indices on the carrier release tape to thereby advance the carrier release tape as said feed wheel rotates, and wherein said feed wheel has radially outwardly extending annular flanges located on each side thereof to maintain the carrier release tape on said feed wheel.

32. An apparatus as defined in claim 31, additionally comprising:

a stripping mechanism located in the path of the carrier release tape after the carrier release tape has been advanced over said adhesive segment application surface to remove adhesive segments from carrier tape to prevent the adhesive segments from reaching said advancement mechanism.

33. An apparatus as defined in claim 32, wherein said stripping mechanism comprises:

a cylindrical roller which is rotatably mounted in said housing, the carrier release tape extending over said cylindrical roller with the side of the carrier release tape upon which the adhesive segments are located facing said cylindrical roller, the adhesive segments thereby being pulled off of the carrier release tape as it passes over said cylindrical roller.

34. An apparatus as defined in claim 33, wherein said cylindrical roller is mounted in said housing so as to be accessible from outside said housing to allow a user to remove adhesive segments collected on said cylindrical roller.

35. An apparatus as defined in claim 31, wherein said index-engaging elements on said feed wheel are uniformly spaced about said outer cylindrical surface of said feed wheel, the spacing between rotationally adjacent ones of said index-engaging elements being identical to the distance between longitudinally adjacent ones of the indices on the carrier release tape.

36. An apparatus as defined in claim 31, additionally comprising:

an element mounted in said housing for removing the carrier release tape from engagement with said feed wheel and directing the spent carrier release tape out of said apparatus.

37. An apparatus as defined in claim 36, additionally comprising:

a guide member mounted in said housing which is spaced away from said removing element and which facilitates the direction of spent carrier release tape out of said apparatus.

38. An apparatus as defined in claim 31, additionally comprising:

an attachment mechanism to facilitate the mounting of said apparatus on a tool balancer to bear the weight of said apparatus.

39. An apparatus as defined in claim 31, additionally comprising:

a stand member for supporting said apparatus thereupon in a manner whereby an adhesive segment located on a portion of the indexed adhesive segment bearing carrier release tape which is located on said adhesive segment application surface will be supported away from contact with either said stand member or a surface upon which said stand member is mounted.

* * * * *